US010485346B2

(12) United States Patent
Jones

(10) Patent No.: US 10,485,346 B2
(45) Date of Patent: Nov. 26, 2019

(54) CHAIR TILT MECHANISM

(71) Applicant: Knoll, Inc., East Greenville, PA (US)

(72) Inventor: Mark Jones, Chorley (GB)

(73) Assignee: Knoll, Inc., East Greenville, PA (US)

( * ) Notice: Subject to any disclaimer, the term of this patent is extended or adjusted under 35 U.S.C. 154(b) by 0 days.

(21) Appl. No.: 16/242,354

(22) Filed: Jan. 8, 2019

(65) Prior Publication Data

US 2019/0223598 A1 Jul. 25, 2019

Related U.S. Application Data

(60) Provisional application No. 62/620,196, filed on Jan. 22, 2018.

(51) Int. Cl.

| | |
|---|---|
| ***A47C 1/02*** | (2006.01) |
| ***A47C 1/023*** | (2006.01) |
| ***A47C 1/032*** | (2006.01) |
| *A47C 3/30* | (2006.01) |
| *A47C 7/00* | (2006.01) |
| *A47C 7/14* | (2006.01) |
| *A47C 1/03* | (2006.01) |

(52) U.S. Cl.

CPC ..... *A47C 1/023* (2013.01); *A47C 1/03255* (2013.01); *A47C 1/03* (2013.01); *A47C 3/30* (2013.01); *A47C 7/004* (2013.01); *A47C 7/14* (2013.01)

(58) Field of Classification Search

CPC ..... A47C 1/023; A47C 1/03255
USPC ..... 297/313, 337
See application file for complete search history.

(56) References Cited

U.S. PATENT DOCUMENTS

| | | | | |
|---|---|---|---|---|
| 6,709,058 | B1 * | 3/2004 | Diffrient | A47C 1/03 297/300.2 |
| 6,817,667 | B2 | 11/2004 | Pennington et al. | |
| 6,824,218 | B1 | 11/2004 | van Hekken | |
| 7,198,329 | B1 | 4/2007 | Larson | |
| 7,837,265 | B2 * | 11/2010 | Machael | A47C 1/023 297/300.2 |
| 7,857,390 | B2 * | 12/2010 | Schmitz | A47C 1/03255 297/300.1 |
| 7,887,131 | B2 | 2/2011 | Chadwick et al. | |
| 8,029,060 | B2 | 10/2011 | Parker et al. | |
| 8,070,230 | B2 * | 12/2011 | Krob | A47C 1/03233 297/300.2 |
| 8,157,329 | B2 | 4/2012 | Masoud et al. | |
| 8,167,373 | B2 | 5/2012 | Allison et al. | |
| 8,216,416 | B2 | 7/2012 | Allison et al. | |

(Continued)

OTHER PUBLICATIONS

International Search Report for PCT/US19/12830 dated Mar. 29, 2019.

(Continued)

*Primary Examiner* — Syed A Islam
(74) *Attorney, Agent, or Firm* — Buchanan Ingersoll & Rooney PC

(57) ABSTRACT

A chair can include a chair back, or backrest, that is coupled to a base of a chair above a seat of the chair. A tilt mechanism can attach the backrest to the base. In some embodiments, the tilt mechanism can be configured so that the backrest rotates about multiple pivots as it reclines from an upright position to a reclined position to drive motion of the seat during recline of the backrest.

20 Claims, 25 Drawing Sheets

Parts Hidden for Clarity – Upright Low Tension

(56) References Cited

U.S. PATENT DOCUMENTS

| | | | | |
|---|---|---|---|---|
| 8,998,322 | B2 * | 4/2015 | Horiki ..... | A47C 1/03255 297/300.1 |
| 2001/0000939 | A1 | 5/2001 | Roslund, Jr. et al. | |
| 2002/0190555 | A1 | 12/2002 | Holbrook et al. | |
| 2003/0168901 | A1 | 9/2003 | Wilkerson et al. | |
| 2006/0006715 | A1 | 1/2006 | Chadwick et al. | |
| 2008/0290712 | A1 | 11/2008 | Parker et al. | |
| 2009/0250988 | A1 | 10/2009 | Catanzarite et al. | |
| 2014/0300158 | A1 * | 10/2014 | Jones ..... | A47C 1/03238 297/303.1 |
| 2016/0310334 | A1 | 10/2016 | Bliem | |

OTHER PUBLICATIONS

Written Opinion of the International Searching Authority for PCT/US19/12830 dated Mar. 29, 2019.

* cited by examiner

Center Section Low Tension – Upright

Off Center Section Low Tension – Upright

Parts Hidden for Clarity – Upright Low Tension

Center Section Low Tension – Reclined

Off Center Section Low Tension – Reclined

Parts Hidden for Clarity – Reclined Low Tension

Center Section High Tension – Upright

Off Center Section High Tension – Upright

Parts Hidden for Clarity– Upright High Tension

Center Section High Tension – Reclined

Off Center Section High Tension – Reclined

Parts Hidden for Clarity – Reclined High Tension

Low Tension Reclined

High Tension Reclined (Full Travel Position)

(Mid Travel Position)

(Non-Travel Position)

CHAIR TILT MECHANISM

CROSS-REFERENCE TO RELATED APPLICATIONS

The present application claims priority to U.S. Provisional Patent Application No. 62/620,196, which was filed on Jan. 22, 2018.

FIELD OF INVENTION

The present invention relates to chairs, tilt mechanisms for chairs, and methods of making and using chairs.

BACKGROUND OF THE INVENTION

Chairs often include a base that supports a seat. Examples of chairs may be appreciated from U.S. Pat. Nos. 8,216,416, 8,167,373, 8,157,329, 8,029,060, 7,887,131, 7,198,329, 6,824,218, and 6,817,667 and U.S. Pat. App. Pub. Nos. 2003/0168901, 2006/0006715, and 2008/0290712. Some chairs may be configured to have a back that tilts from an upright position to a recline position.

SUMMARY OF THE INVENTION

A chair is provided that includes a seat, a backrest, and a base. The chair can include a tilt mechanism to facilitate tilting of the backrest from an upright position to a reclined position. The tilt mechanism can also be configured to tilt the seat or otherwise move the seat when the backrest is tilted. In some embodiments, the tilt mechanism can be configured so that the seat moves forwardly when the backrest is tilted to the reclined position. In other embodiments, the tilt mechanism can also be configured so that the seat moves upwardly or downwardly at the same time the seat is moved forwardly or rearwardly during recline of the backrest. In yet other embodiments, the tilt mechanism can be configured to tilt the seat when the backrest is also tilted, but not move the seat forwardly or rearwardly other than the rotational motion of the seat that occurs via the tilting effected via the tilt mechanism. In yet other embodiments, the tilt mechanism may only be configured to tilt the backrest so that the seat does not tilt or move when the backrest is tilted.

For example, a chair can include a seat, a backrest and a base. The backrest can include a frame having a lower portion and a first leg that extends forwardly from the lower portion to a position below the seat and within a housing of a tilt mechanism. The seat can be supported by the base. The tilt mechanism can be attached to the base and can include a spring that is positioned to extend vertically within a column where the spring is compressible and extendable. The tilt mechanism can also include a first spring connecting member that has a lower end connected to the spring and an upper end pivotally connected to a first end of a first tilt member. A second end of the first tilt member can be pivotally connected to a second end of a second tilt member. A first end of the second tilt member can be pivotally connected to a portion of a forward distal end of the first leg extending from the lower portion of the frame of the backrest.

The spring of the tilt mechanism can be a coil spring, an elastomeric spring or other type of spring. In some embodiments, the spring can be a coil spring that is positioned around a gas spring within the column that is actuatable for height adjustment of the seat. The gas spring can be positioned within the central opening of the coil spring that extends along the length of the coil spring. The central opening can be defined by the body of the coil spring as an inner passageway that extends along the length of the coil spring.

The frame of the backrest can have more than just a first leg. For example, the frame of the backrest can include a second leg that extends forwardly form the lower portion to a position below the seat that is within a housing of a tilt mechanism. The tilt mechanism can also include elements for connecting to the second leg. For example, the tilt mechanism can include a second spring connecting member that has a lower end connected to the spring and an upper end pivotally connected to a first end of a third tilt member. A second end of the third tilt member can be pivotally connected to a second end of a fourth tilt member. A first end of the fourth tilt member can be pivotally connected to a portion of a forward distal end of the second leg extending from the lower portion of the frame of the backrest.

The tilt mechanism can include a leverage adjustment mechanism. The leverage adjustment mechanism can include a leverage adjustment actuator connected to a rotatable member. The rotatable member can be connected to a first node positioning member so that rotation of the rotatable member in a first rotational direction drives linear motion of the first node positioning member in a forward direction and rotation of the rotatable member in a second rotational direction that is opposite the first rotational direction drives motion of the first node positioning member in a rearward direction. The rotatable member can also be connected to a second node positioning member so that rotation of the rotatable member in the first rotational direction drives linear motion of the second node positioning member in a forward direction and rotation of the rotatable member in the second rotational direction drives motion of the second node positioning member in a rearward direction. A first node can be provided that engages the first tilt member. The first node can be attached to the first node positioning member such that the first node moves forwardly when the first node positioning member is moved forwardly via rotation of the rotatable member in the first rotational direction and the first node moves rearwardly when the first node positioning member is moved rearwardly via rotation of the rotatable member in the second rotational direction. A second node that engages the third tilt member can also be provided. The second node can be attached to the second node positioning member such that the second node moves forwardly when the second node positioning member is moved forwardly via rotation of the rotatable member in the first rotational direction and the second node moves rearwardly when the second node positioning member is moved rearwardly via rotation of the rotatable member in the second rotational direction. The first and second nodes can be positioned so that motion of the first node and second node can adjust a mechanical leverage applicable to the spring to adjust an amount of force needed to be exerted on the backrest to compress the spring.

Embodiments of the chair can also include a tilt limiter mechanism. For example, some embodiments can include a tilt limiter mechanism that includes an adjustable actuator connected to a tilt limiter member within the housing of the tilt mechanism. The tilt limiter member can be positioned within a slot defined by structure within the housing of the tilt mechanism such that movement of the actuator adjusts a position of the tilt limiter member within the slot.

As another example, a tilt limiter mechanism can include an adjustable actuator connected to a tilt limiter member within the housing of the tilt mechanism where the tilt limiter member is moveably positioned to engage the first tilt member. The tilt limiter member can be stepped so that a first position of the tilt limiter member prevents recline of the backrest, a second position of the tilt limiter permits the first tilt member to move so that the backrest is adjustable from the upright position toward the reclined position, and a third position of the tilt limiter permits the first tilt member to move so that the backrest is moveable to a position that is between the upright position and the reclined position. Embodiments of the tilt limiter mechanism can also include a shaft positioned within a slot. The shaft can be connected to the tilt limiter member such that the shaft is moveable within the slot when a position of the tilt limiter member is adjusted. The tilt limiter mechanism can also include a first spring that is configured to facilitate movement of the actuator of the tilt limiter mechanism and a second spring that is configured to provide a pre-selected biasing force to prevent adjustment of the tilt limiter member when the backrest is in the reclined position. The second spring can be positioned so that the second spring is connected to the tilt limiter member so that the second spring moves in response to the actuator of the tilt limiter mechanism being adjusted only when the backrest is in the upright position to effect motion of the tilt limiter member in response to movement of the actuator.

Embodiments of the chair can utilize a tilt mechanism that includes a leverage adjustment mechanism. Some embodiments of the leverage adjustment mechanism can include a leverage adjustment actuator connected to a rotatable member. The rotatable member can be connected to a node positioning member so that rotation of the rotatable member in a first rotational direction drives linear motion of the node positioning member in a forward direction and rotation of the rotatable member in a second rotational direction that is opposite the first rotational direction drives motion of the node positioning member in a rearward direction. A node that engages the first tilt member can be attached to the node positioning member such that the node moves forwardly when the node positioning member is moved forwardly via rotation of the rotatable member in the first rotational direction and the node moves rearwardly when the node positioning member is moved rearwardly via rotation of the rotatable member in the second rotational direction. The node can be positioned so that motion of the node to adjust a position of the node adjusts a mechanical leverage applicable to the spring to adjust an amount of force needed to be exerted on the backrest to compress the spring.

A method of using a chair is also provided. An embodiment of the chair that is used in the method can be an embodiment of a chair disclosed herein. Some embodiments of the chair can include providing a chair, adjusting a position of a node that engages the first tilt member such that the node moves forwardly or rearwardly to adjust a mechanical leverage applicable to the spring to adjust an amount of force needed to be exerted on the backrest to compress the spring and recline the backrest; and manipulating an actuator of a tilt limiter mechanism of the chair to adjust an extent to which the backrest is reclineable while the backrest is reclined.

In some embodiments of the method, the adjusting of the position of the node occurs via the node moving forwardly along a plate of the first tilt member. In other embodiments, the adjusting of the position of the node occurs via the node moving rearwardly along a plate of the first tilt member. In other embodiments, the adjusting can occur via movement of the node forwardly and rearwardly to different positions.

Embodiments of the method can also include other steps. For example, an embodiment of the method can include delaying adjustment of the tilt limiter mechanism to occur via the manipulating of the actuator of the tilt limiter mechanism so that adjustment of the tilt limiter mechanism is only effected after the backrest is moved to the upright position and is no longer reclined. In some embodiments, the delaying adjustment of the tilt limiter mechanism can include a spring of the tilt limiter mechanism having a pre-selected biasing force resiliently moving in response to motion of the actuator of the tilt limiter mechanism when the backrest is reclined to prevent adjustment of a detent mechanism for adjusting a position of the tilt limit member when the backrest is reclined. The pre-selected biasing force can be a force that is less than a force needed to overcome force acting on the tilt limiter mechanism when the backrest is reclined to prevent overloading of components of the chair.

Other details, objects, and advantages of the invention will become apparent as the following description of certain present preferred embodiments thereof and certain present preferred methods of practicing the same proceeds.

BRIEF DESCRIPTION OF THE DRAWINGS

Exemplary embodiments of the chair and tilt mechanism for the chair are shown in the accompanying drawings. It should be appreciated that like reference numbers used in the drawings may identify like components.

DETAILED DESCRIPTION OF EXEMPLARY EMBODIMENTS

Figure 1:
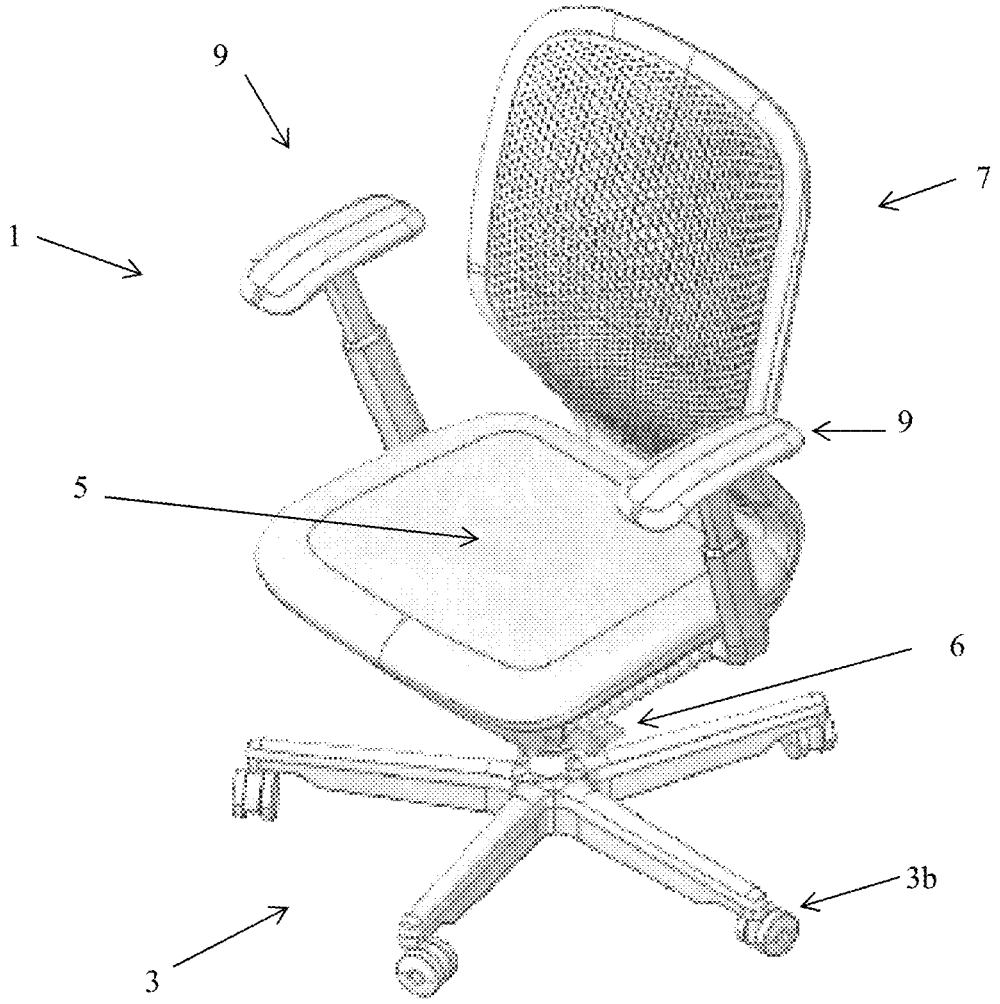
FIG. 1 is a perspective view of a first exemplary embodiment of a chair.
Figure 2:
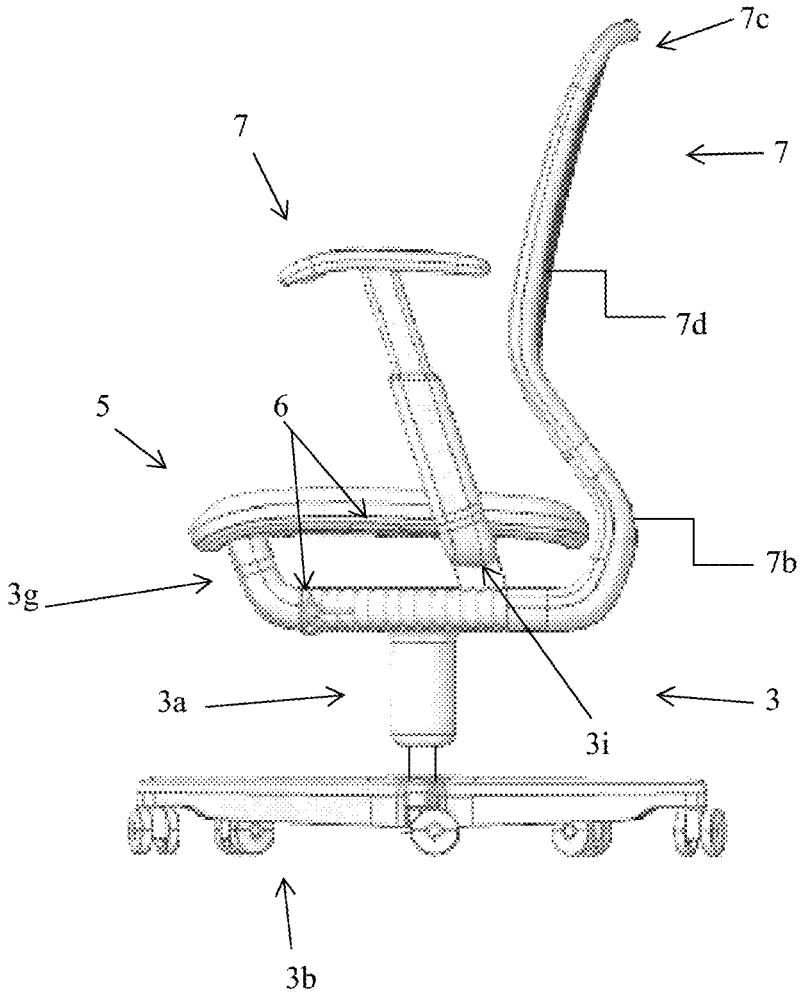
FIG. 2 is a side view of the first exemplary embodiment of the chair.
Figure 3:
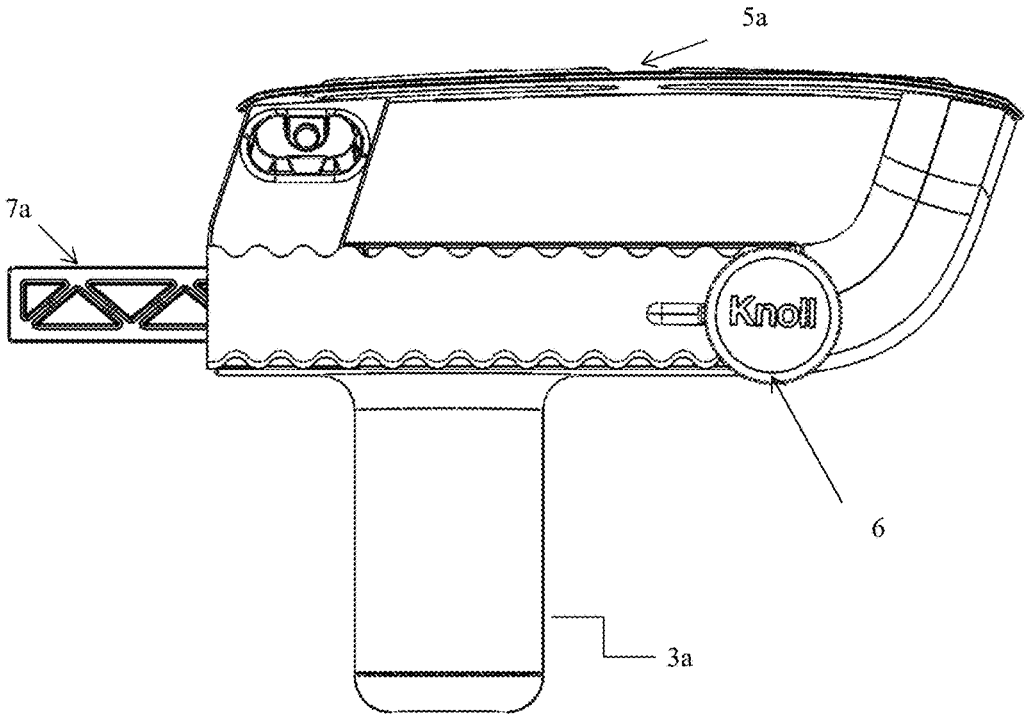
FIG. 3 is a fragmentary side view of the first exemplary embodiment of the chair.
Figure 4:
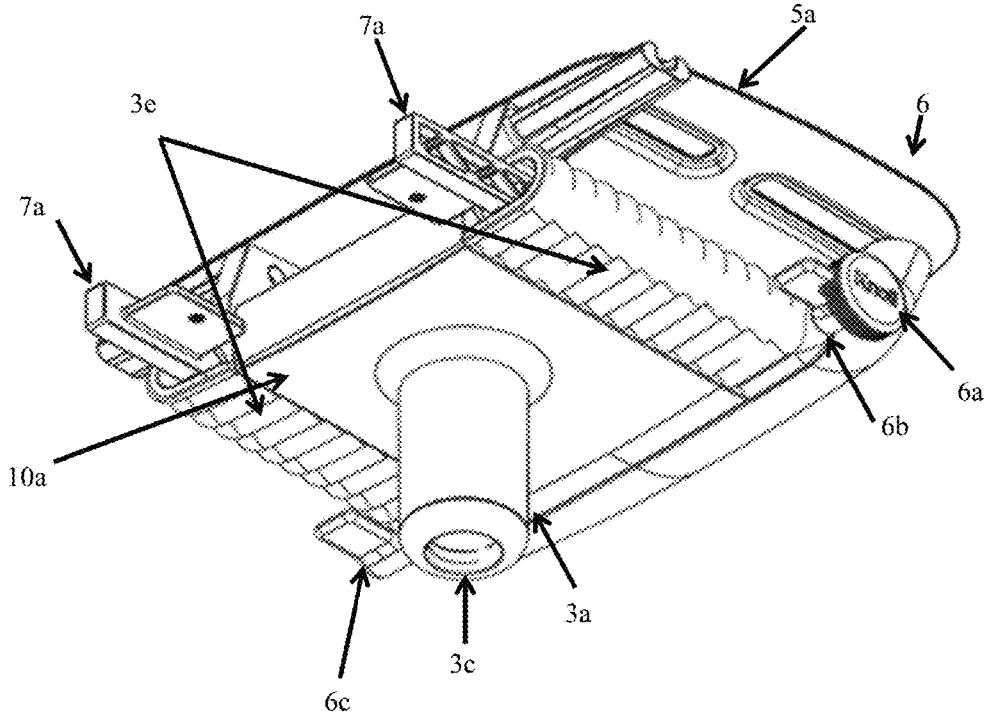
FIG. 4 is a fragmentary bottom view of the first exemplary embodiment of the chair.
Figure 5:
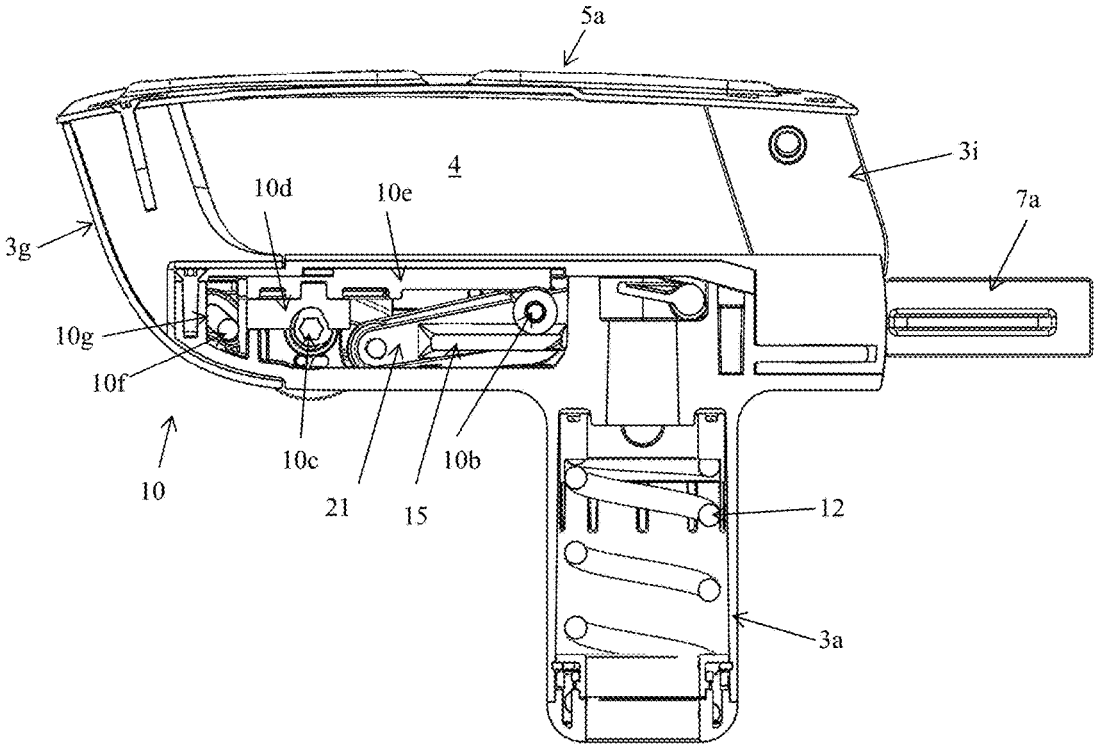
FIG. 5 is a first centered cross sectional view of the first exemplary embodiment of the chair in an upright position with the tilt mechanism in a first lower tension position.
Figure 6:
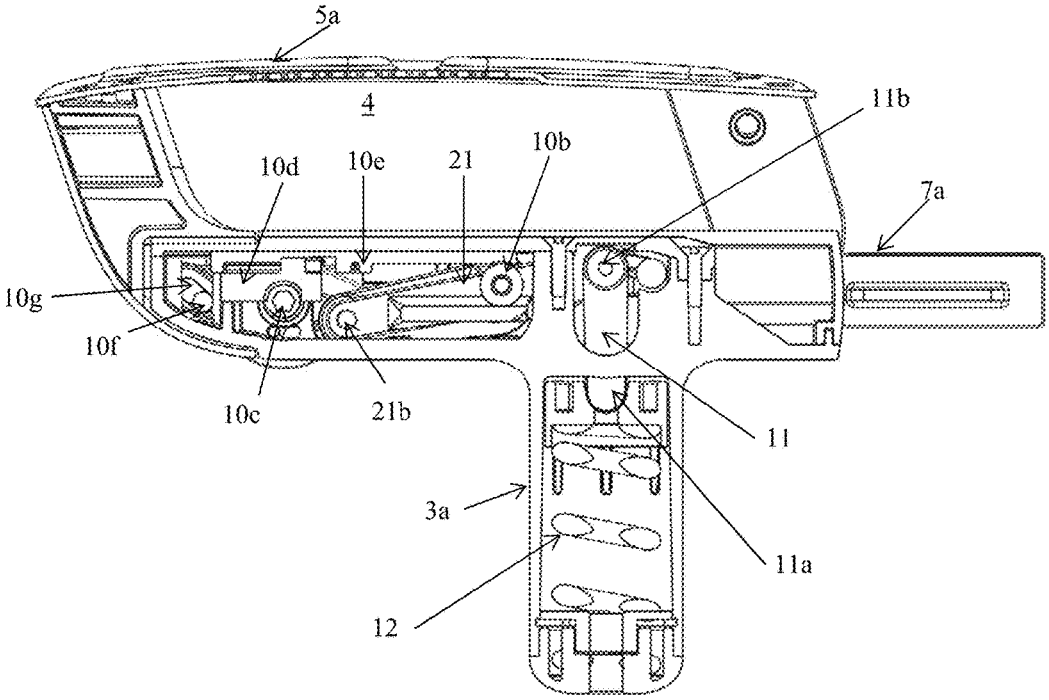
FIG. 6 is a second off-center cross sectional view of the first exemplary embodiment of the chair in an upright position with the tilt mechanism in a first lower tension position.
Figure 7:
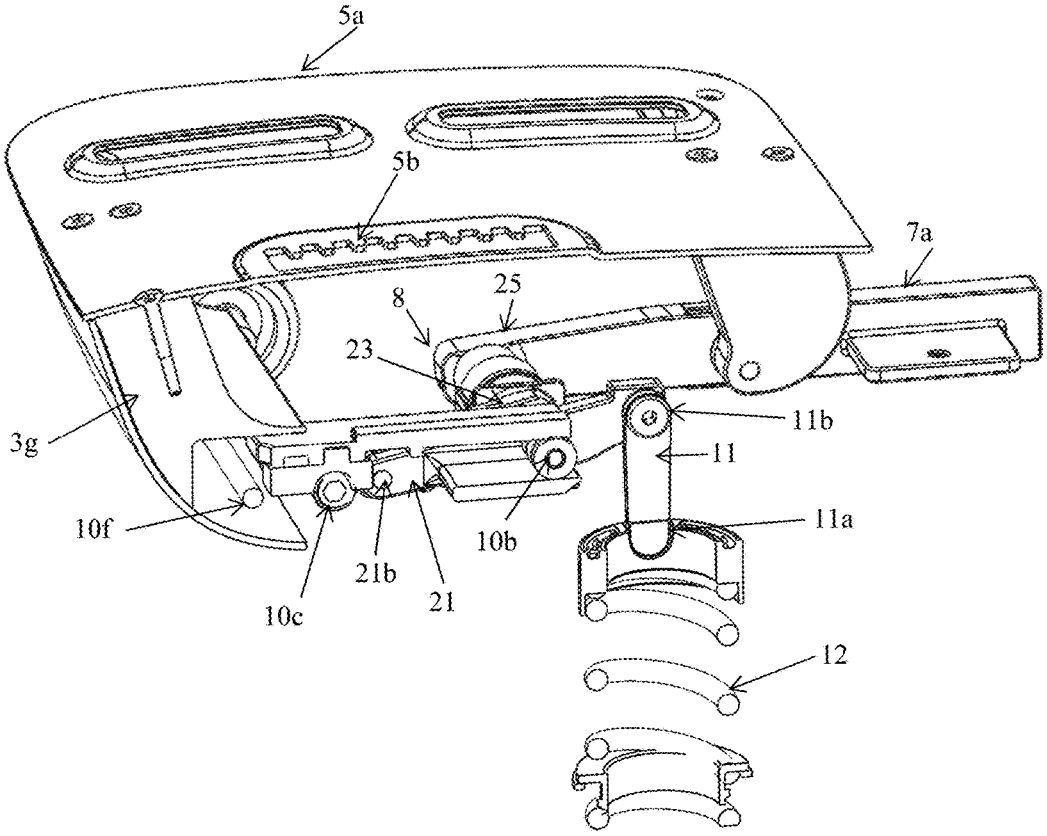
FIG. 7 is a third cross sectional view of the first exemplary embodiment of the chair in an upright position with the tilt mechanism in a first lower tension position and with parts hidden to better illustrate portions of the mechanism.
Figure 8:
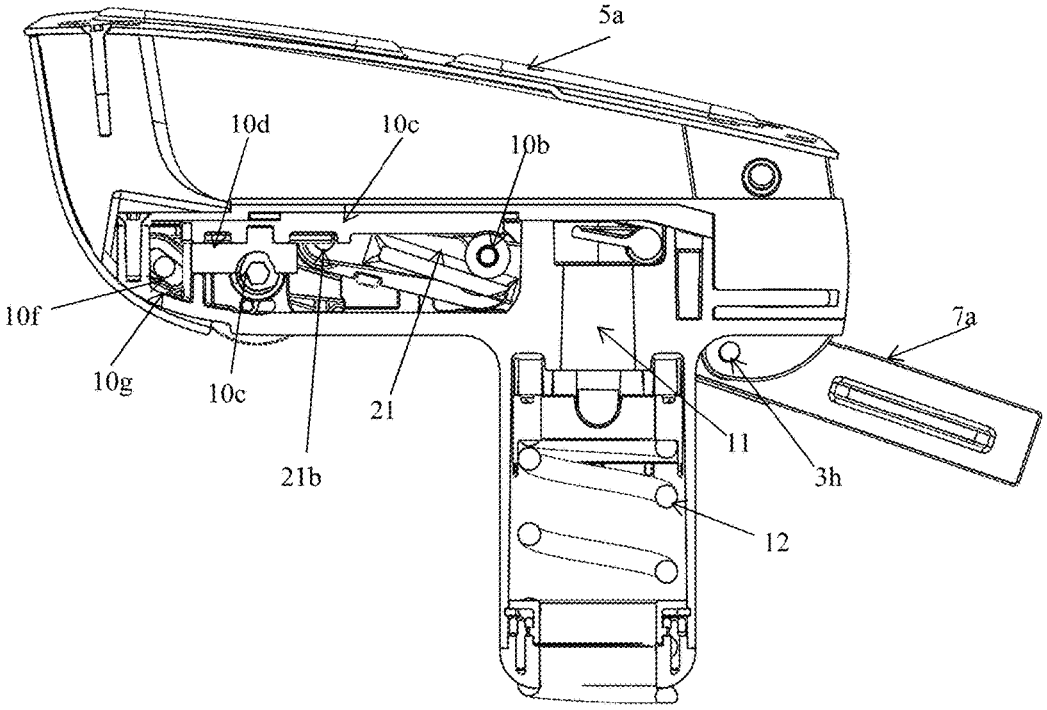
FIG. 8 is a first centered cross sectional view of the first exemplary embodiment of the chair in a reclined position with the tilt mechanism in a first lower tension position.
Figure 9:
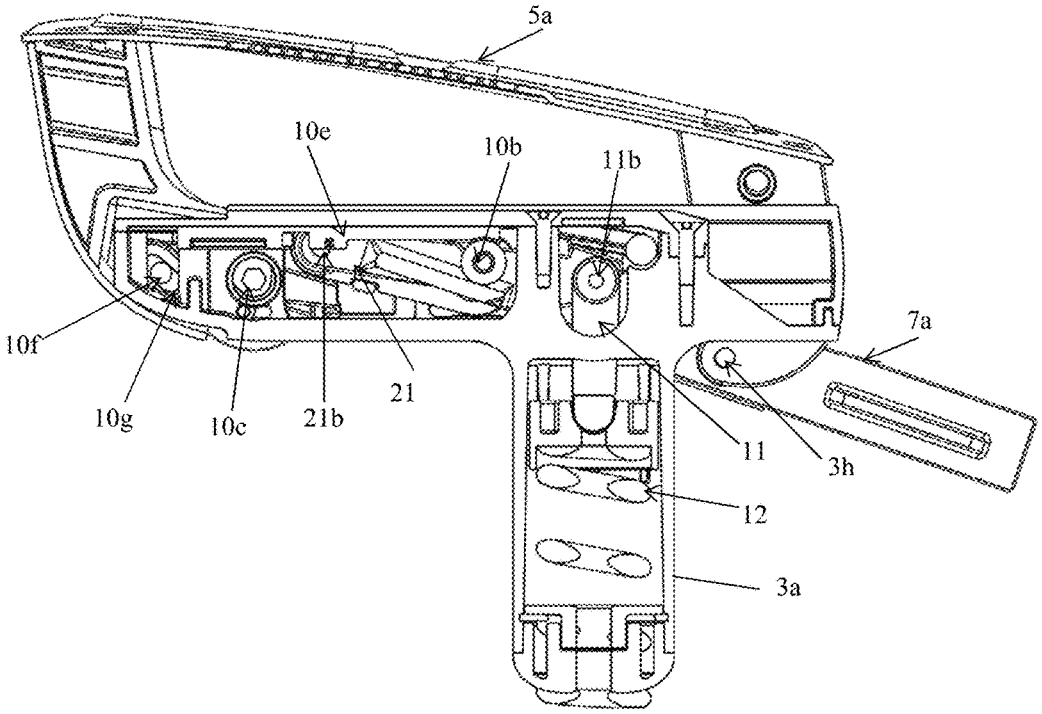
FIG. 9 is a second off-center cross sectional view of the first exemplary embodiment of the chair in a reclined position with the tilt mechanism in a first lower tension position.
Figure 10:
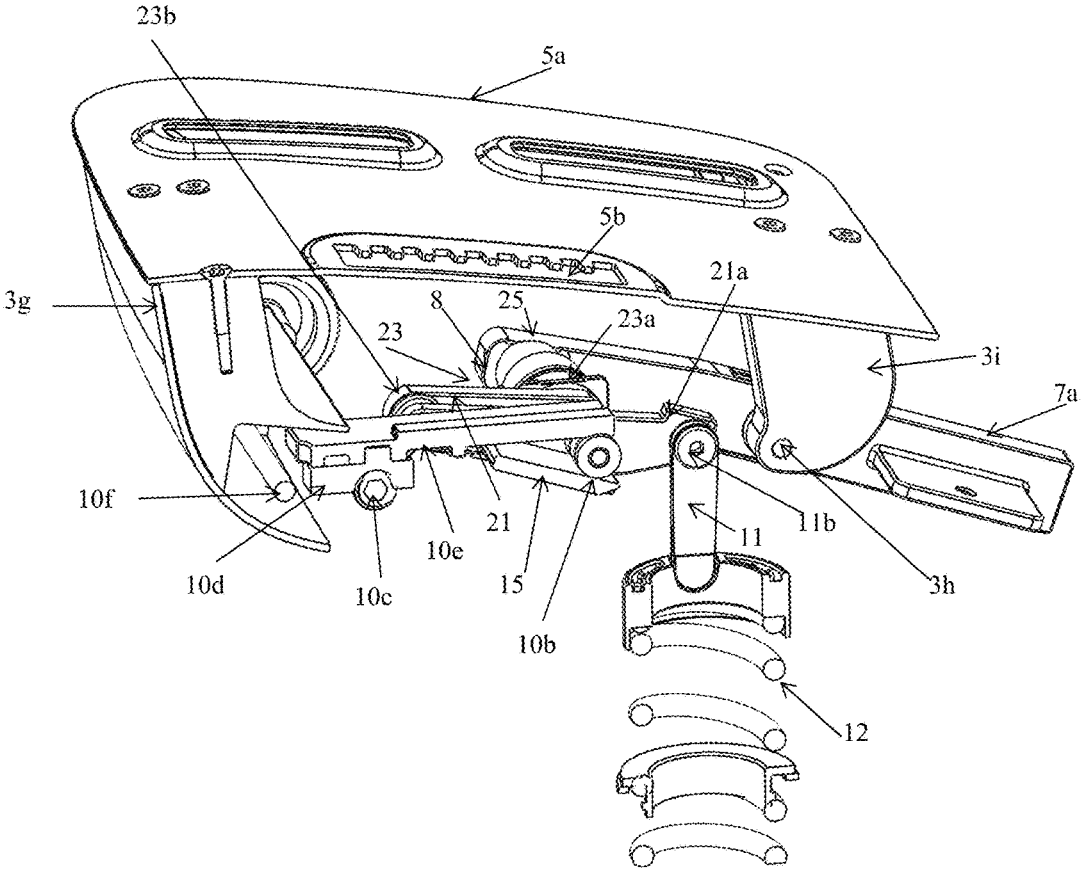
FIG. 10 is a third cross sectional view of the first exemplary embodiment of the chair in a reclined position with the tilt mechanism in a first lower tension position and with parts hidden to better illustrate portions of the mechanism.
Figure 11:
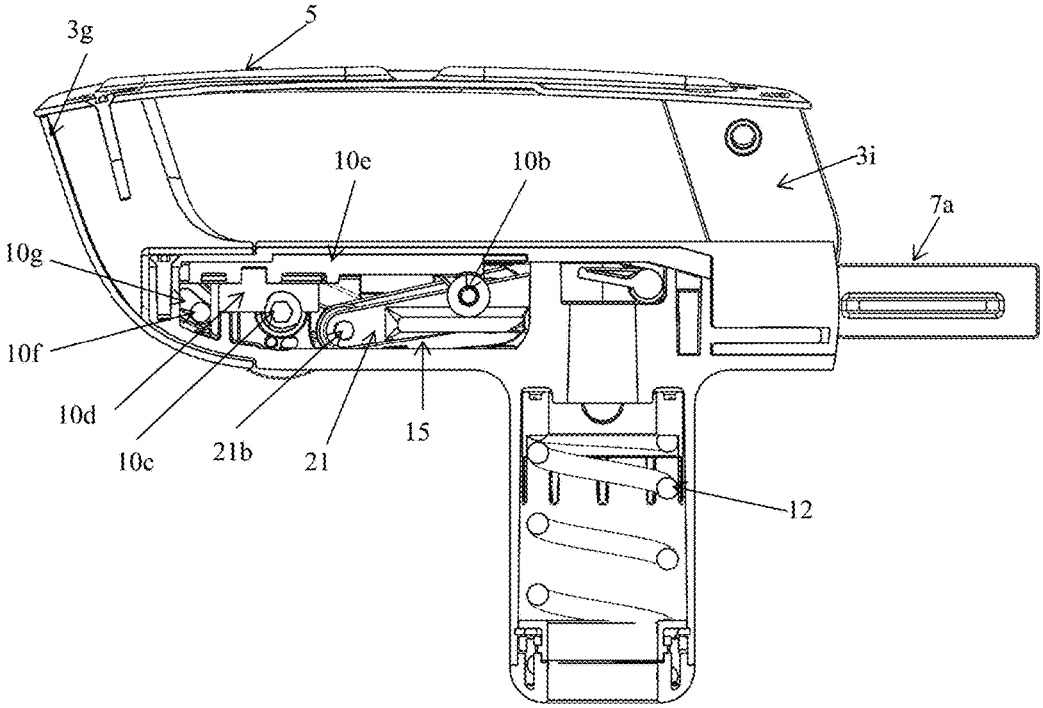
FIG. 11 is a first centered cross sectional view of the first exemplary embodiment of the chair in an upright position with the tilt mechanism in a second higher tension position.
Figure 12:
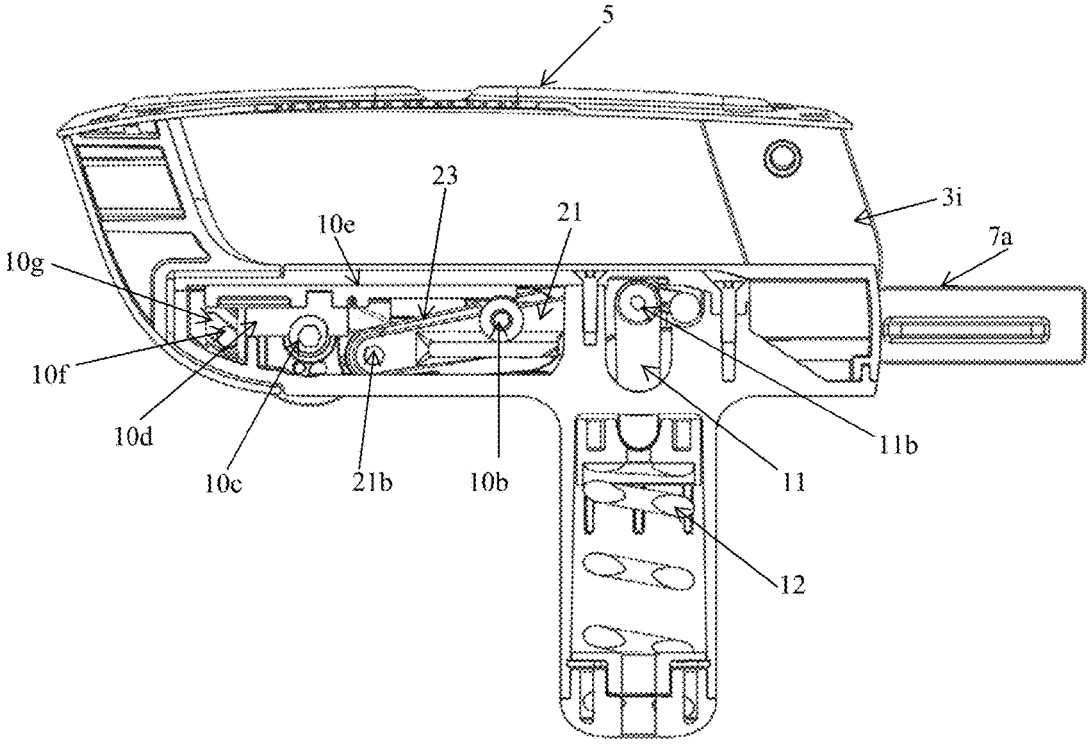
FIG. 12 is a second off-center cross sectional view of the first exemplary embodiment of the chair in an upright position with the tilt mechanism in a second higher tension position.
Figure 13:
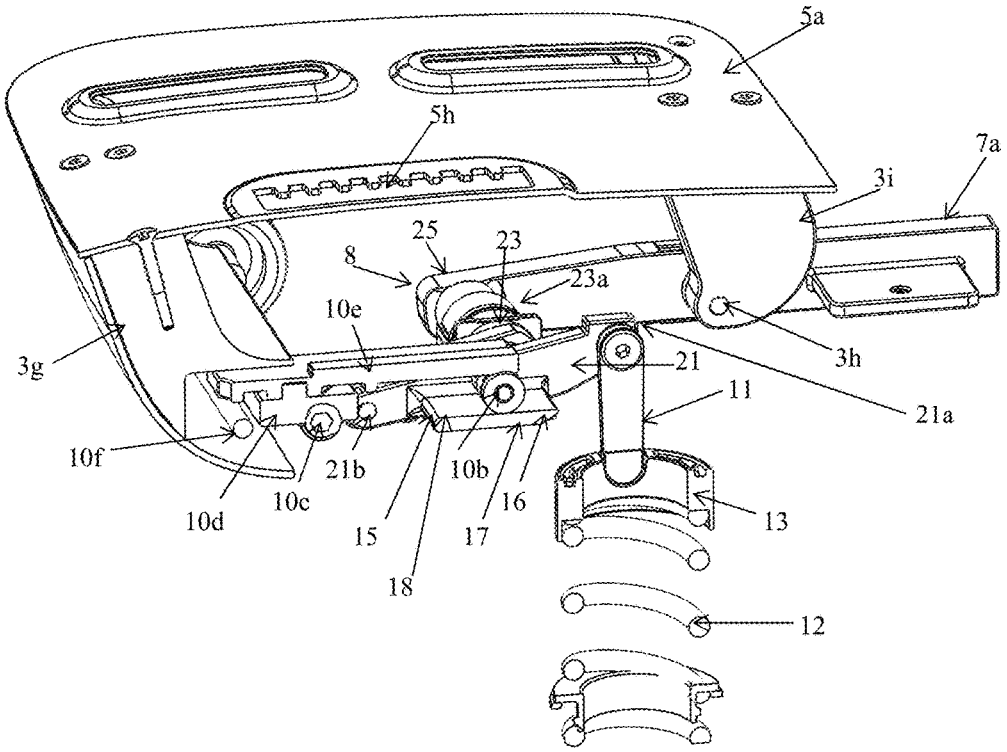
FIG. 13 is a third cross sectional view of the first exemplary embodiment of the chair in an upright position with the tilt mechanism in a second higher tension position and with parts hidden to better illustrate portions of the mechanism.
Figure 14:
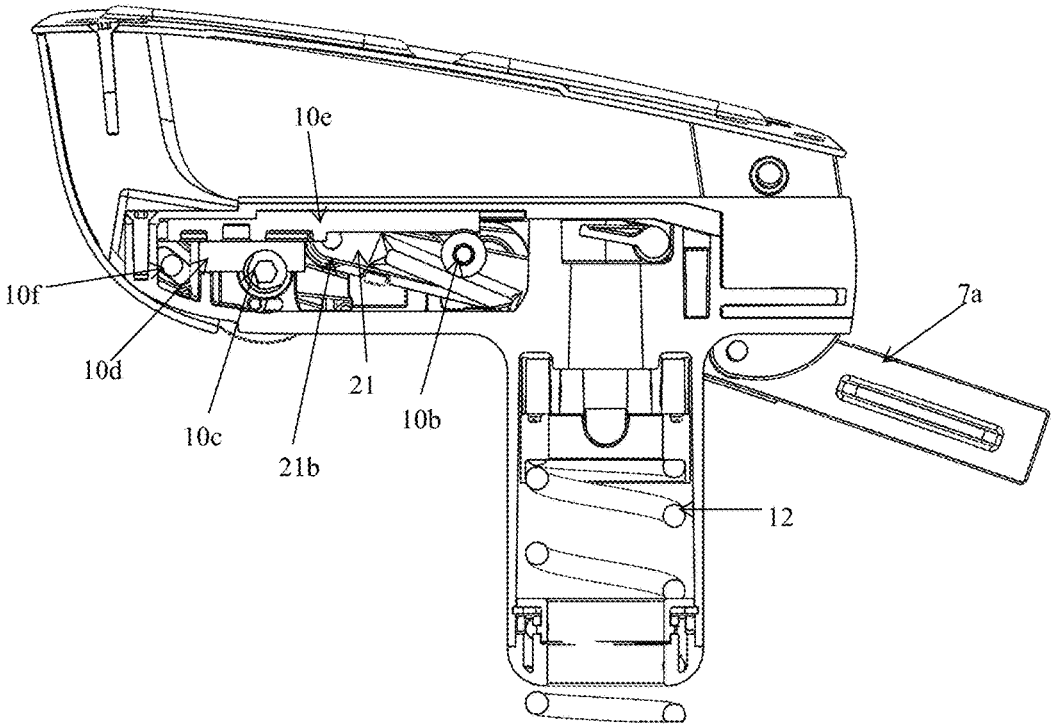
FIG. 14 is a first centered cross sectional view of the first exemplary embodiment of the chair in a reclined position with the tilt mechanism in a second higher tension position.
Figure 15:
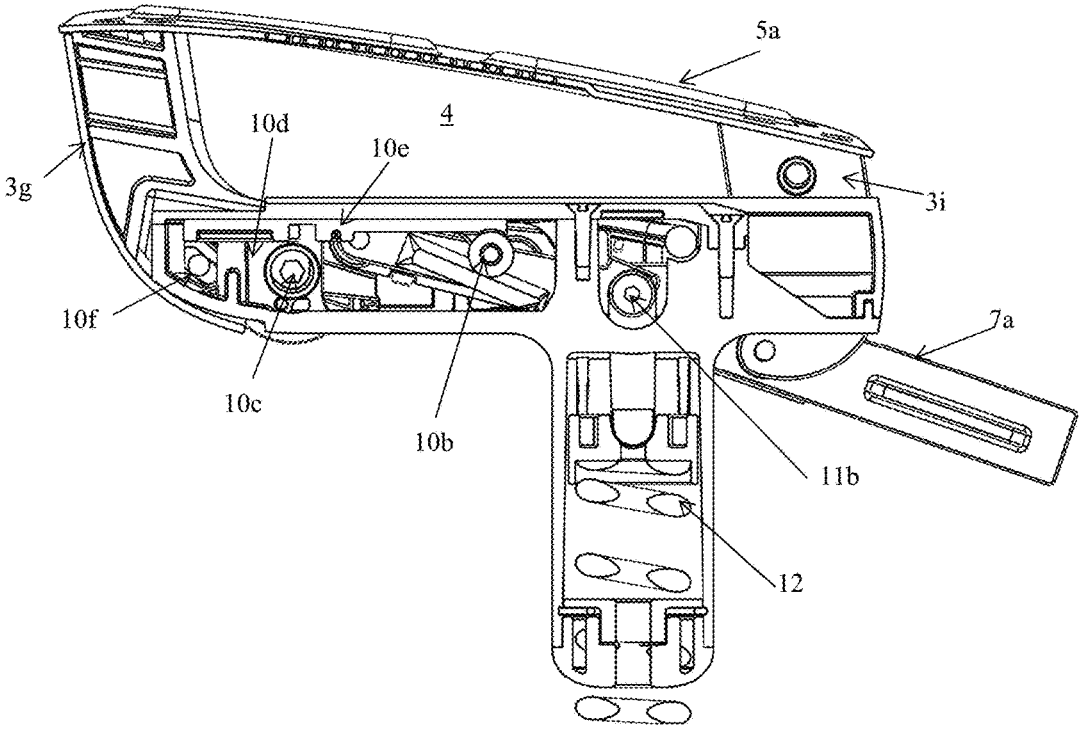
FIG. 15 is a second off-center cross sectional view of the first exemplary embodiment of the chair in a reclined position with the tilt mechanism in a second higher tension position.
Figure 16:
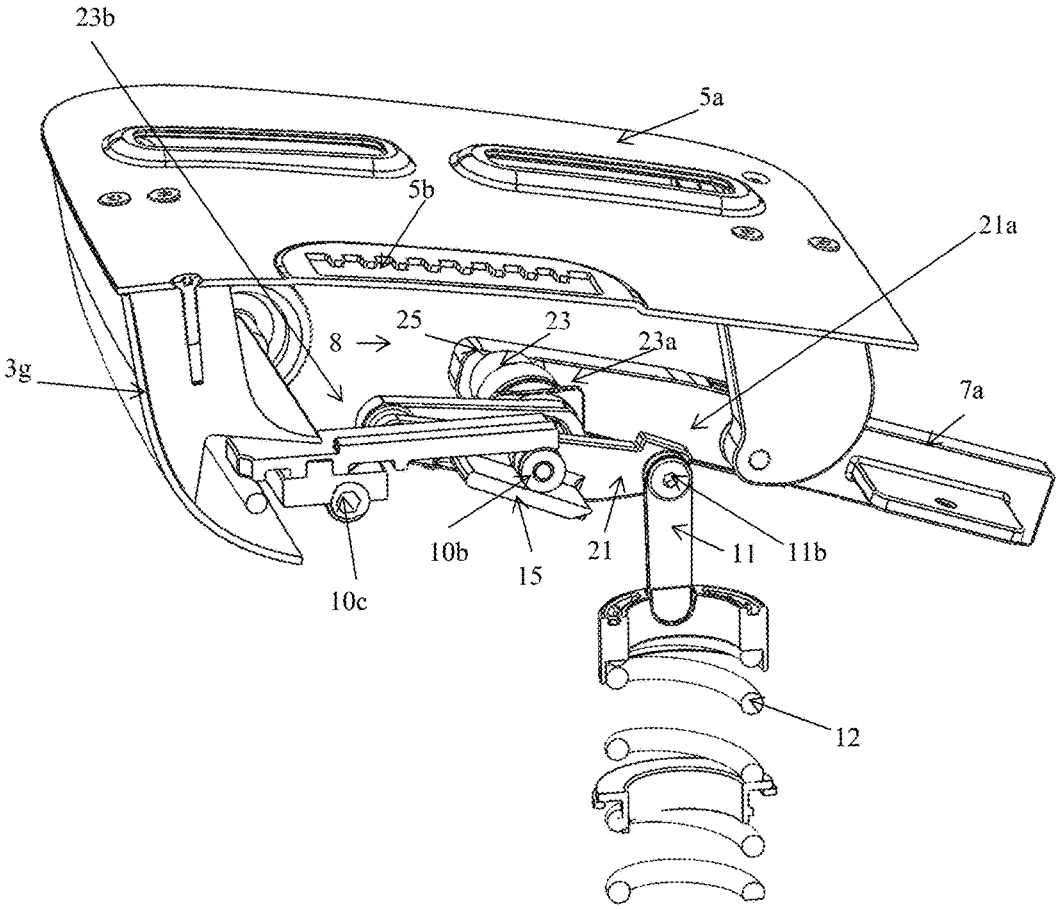
FIG. 16 is a third cross sectional view of the first exemplary embodiment of the chair in a reclined position with the tilt mechanism in a second higher tension position and with parts hidden to better illustrate portions of the mechanism.
Figure 17:
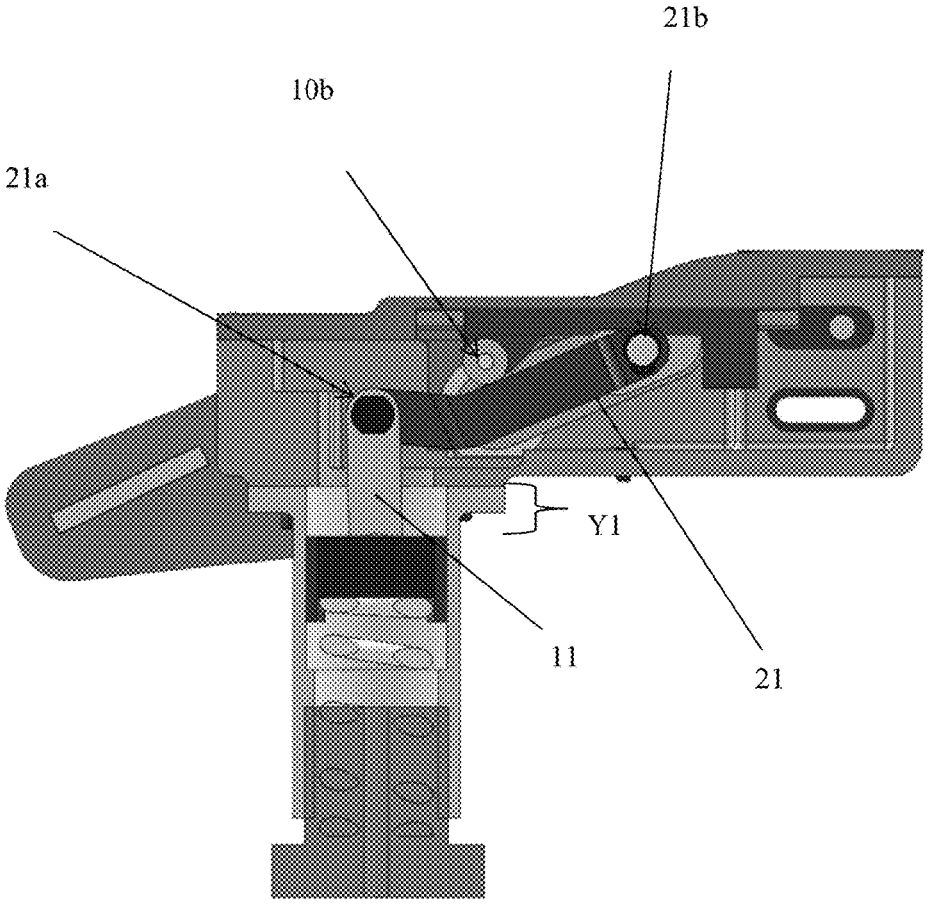
FIG. 17 is a schematic image of the first exemplary embodiment of the chair in a reclined position with the tilt mechanism in a lower tension position.
Figure 18:
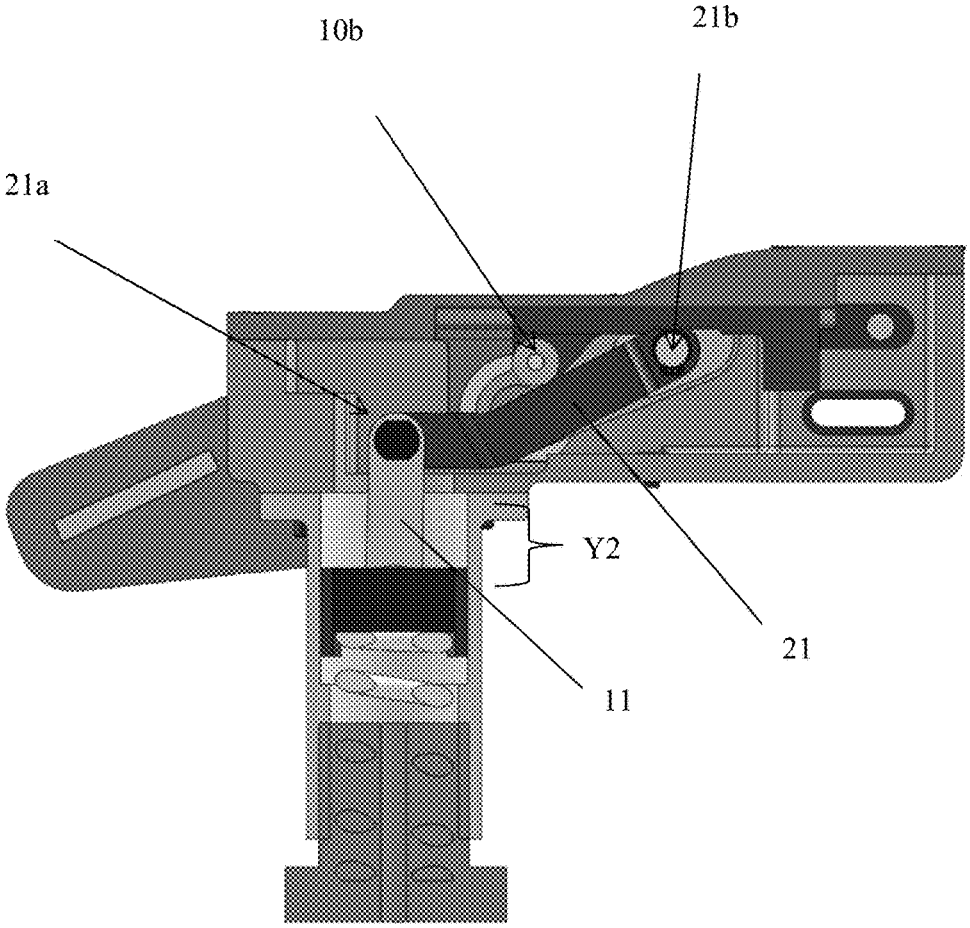
FIG. 18 is a schematic image of the first exemplary embodiment of the chair in a reclined position with the tilt mechanism in a higher tension position.
Figure 19:
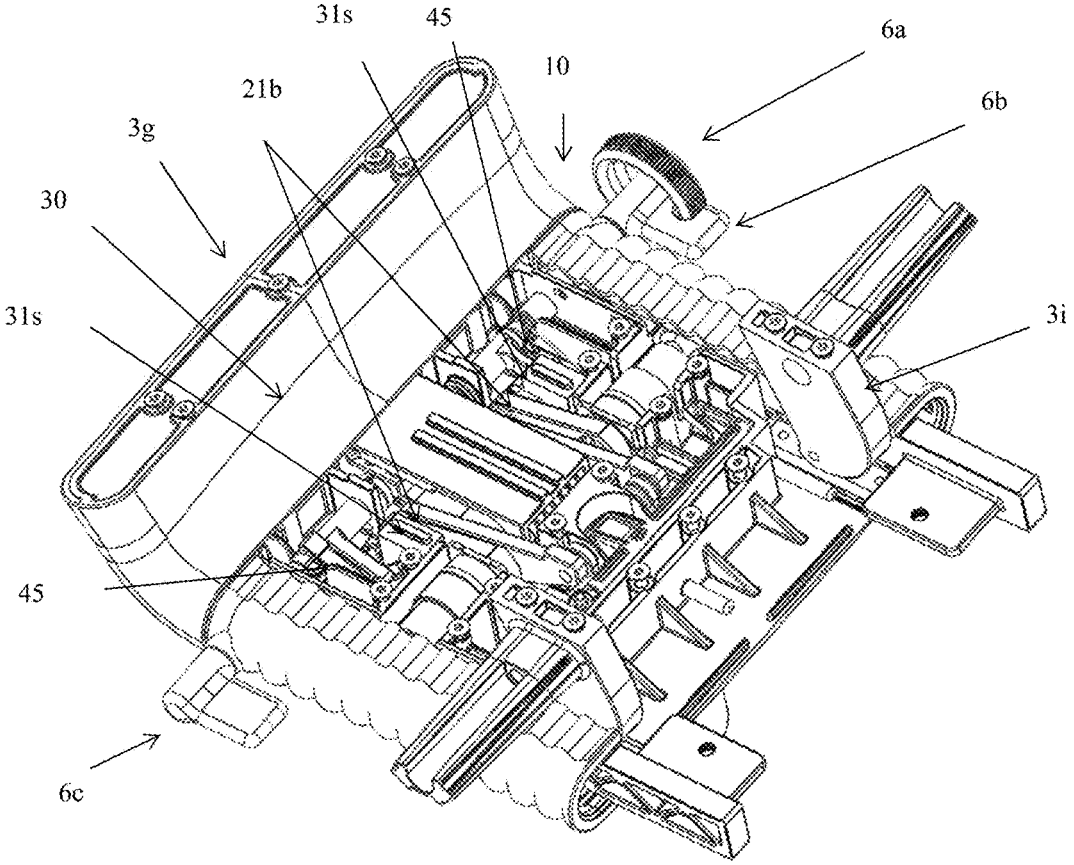
FIG. 19 is a fragmentary perspective view of the first exemplary embodiment of the chair illustrating internal components of the tilt mechanism 10.
Figure 20:
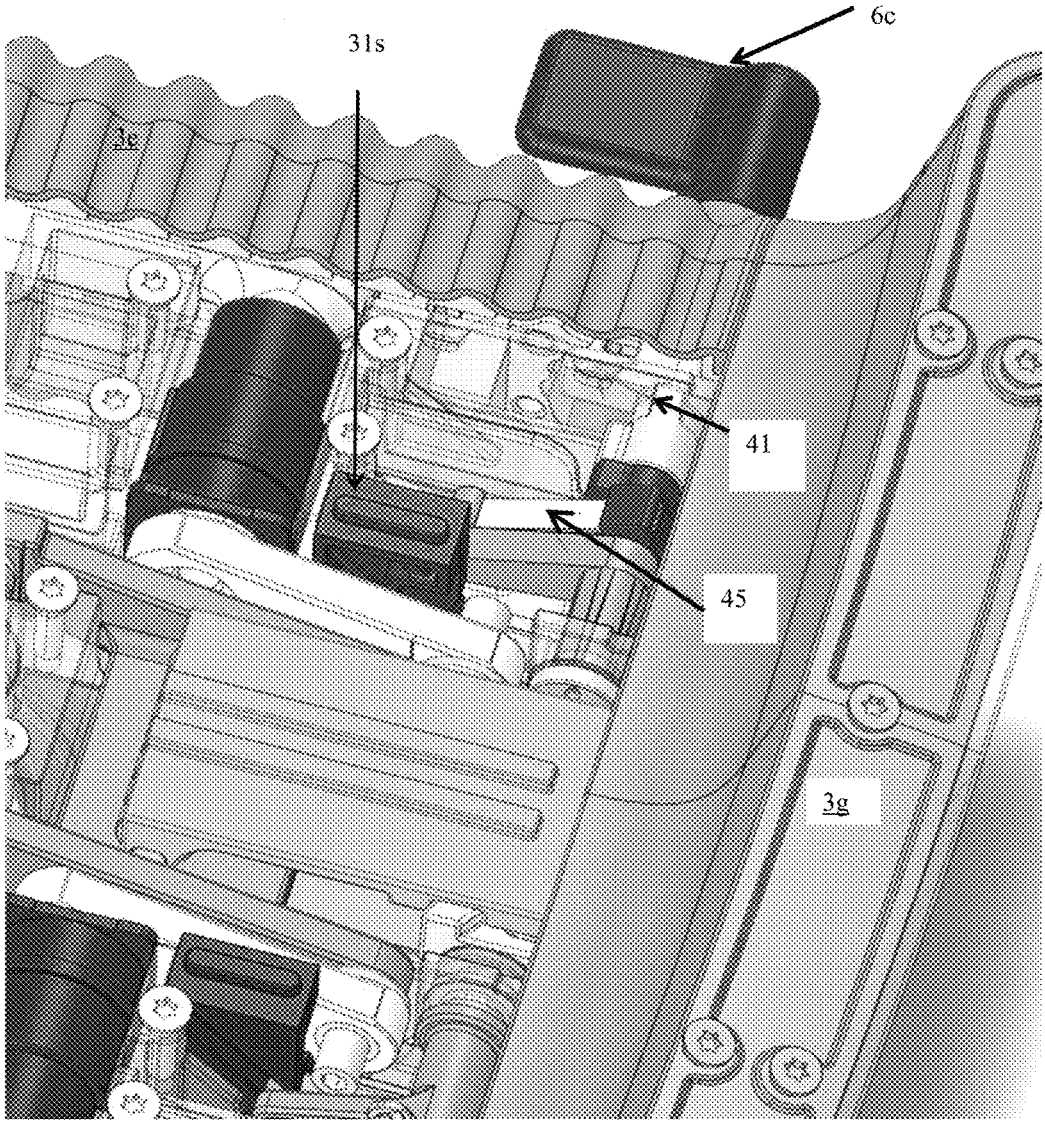
FIG. 20 is a fragmentary perspective view of the first exemplary embodiment of the chair illustrating internal components of the tilt mechanism 10.
Figure 21:
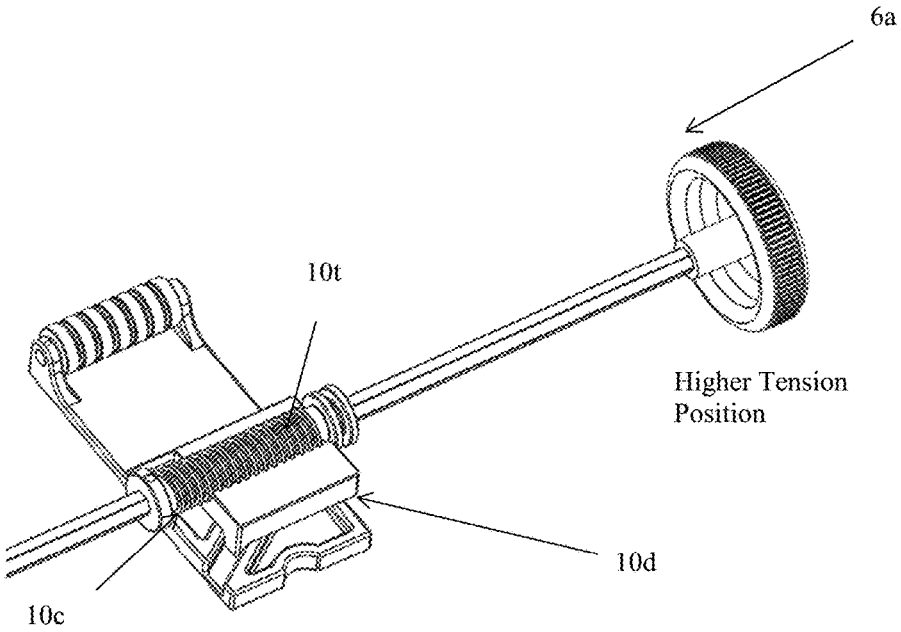
FIG. 21 is a fragmentary view of an adjustment mechanism of the tilt mechanism 10 of the first exemplary embodiment of the chair in a first position.
Figure 22:
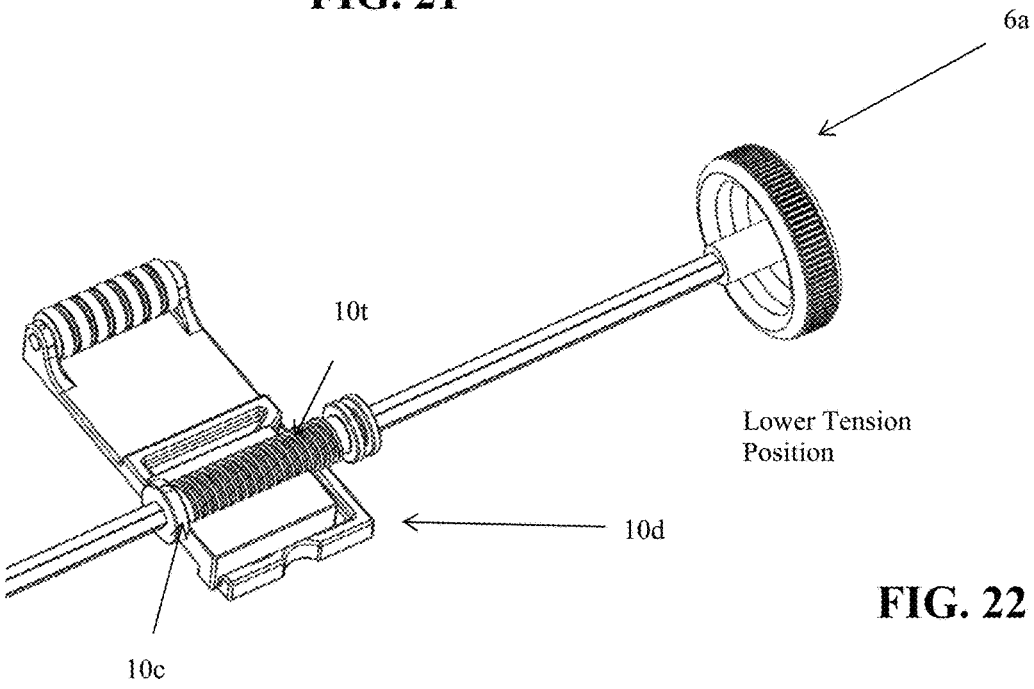
FIG. 22 is a fragmentary view of an adjustment mechanism of the tilt mechanism 10 of the first exemplary embodiment of the chair in a second position.
Figure 23:
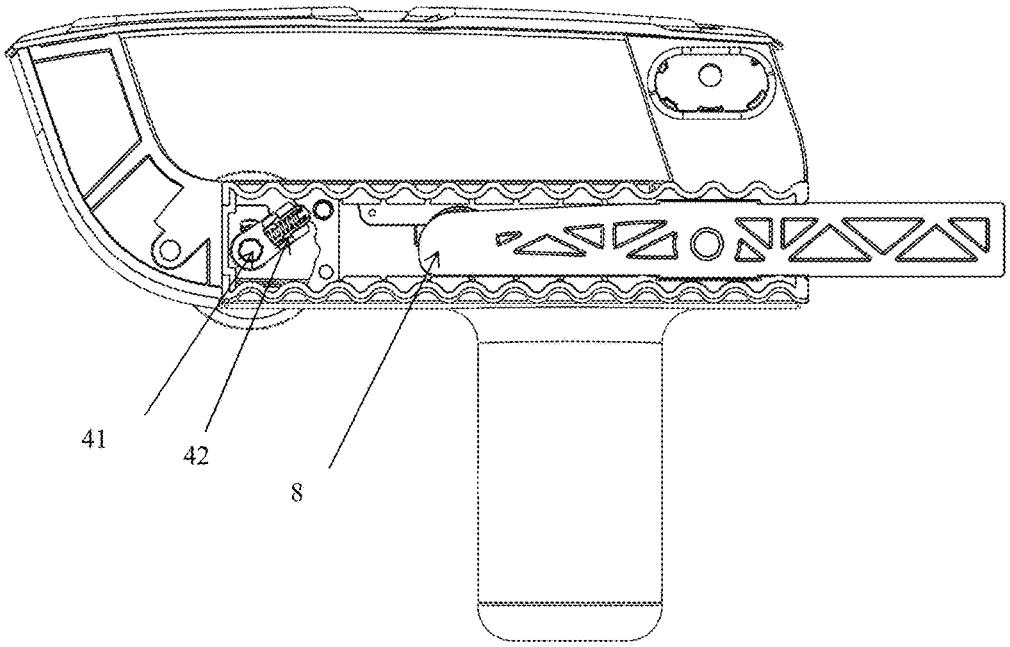
FIG. 23 is a fragmentary side view of the first exemplary embodiment of the chair with portions of the chair cut away to illustrate components of a tilt limiting mechanism.

Referring to FIGS. 1-26, a chair 1 can include a base 3 that supports a seat 5 and a backrest 7. The base 3 can be configured as a pedestal base 3*b* that is supported by rotatable castors that engage the floor and are moveable to allow the base to be slid or wheeled along a floor and includes a vertically extending column 3*a*. A gas spring can be positioned within a channel 3*d* defined in the column 3*a*. The gas spring can extend upwardly from within the column 3*a* to and/or within a housing 10*a* for a tilt mechanism 10. The gas spring can be actuatable via an actuator 6 connected to the gas spring to allow for height adjustment of the seat 5 and backrest 7 so that the seat and backrest are vertically moveable relative to the base 3 and floor on which the base can be positioned between uppermost and lowermost positions.

A spring 12 can also be positioned within the column 3*a* inside the vertically extending channel 3. The spring 12 can be a coil spring, an elastomeric elongated spring, or other type of spring element. The spring 12 can be positioned so that it extends within the column 3*a* outside of the gas spring along a periphery of the gas spring within the column 3*a*. The gas spring can be within a conduit of the spring 12 (e.g. within a central opening defined by the spring 12, within a central conduit defined by the length of the body of a coil spring when the spring 12 is a coil spring, etc.). In some alternative embodiments, the base 3 can be configured to have a plurality of legs that can have a bottom end that contact the floor or directly engage a floor or are attached to glides that are configured to contact the floor.

The chair 1 can include armrests 9 positioned above the seat 5. The armrests 9 can be attached to a portion of the back frame of the backrest 7, a portion of the seat frame of the seat 5, and/or the base 3 so that the armrests 9 are supported above the seat 5. The armrests 9 may be moveable independent of the base 3 and/or backrest 7 or may be affixed to the backrest 7 such that the armrests 9 move in coordination with and simultaneously with the backrest 7 as the backrest 7 moves between an upright position and a reclined position.

The seat 5 can include a seat frame 5*a* that includes a seat plate that may be attached to a tilt mechanism 10 and/or the base 3. The seat frame 5*a* can help support other seat components (e.g. a seat skin, a cushion covered by a leather or fabric covering, etc.). The seat frame 5*a* can also include a seat slide mechanism 5*b* that is configured to permit the seat to be horizontally adjustable along the seat frame 5*a* independent of the base and backrest so that the seat 5 can be slid forwardly and rearwardly between forward and rearward positions defined by the seat slide mechanism 5*b*. An actuator 6 can be connected to the slide mechanism so that a user may move the actuator 6 from a locked position to an unlocked position so that the user can exert a force on the seat to effect a horizontal sliding movement along a track defined by the seat slide mechanism 5*b*. The track can at least be partially defined in a part of the seat frame.

The seat 5 and backrest 7 can be coupled to each other via a tilt mechanism 10 so that the backrest 7 can be tilted between an upright position and a reclined position such that the seat 5 synchronously moves as the backrest 7 is moved. Such movement can be appreciated from FIGS. 5-16. The tilt mechanism 10 can be configured to bias the backrest 7 to its upright position and the seat 5 to its corresponding first position. The tilt mechanism 10 can also be configured to facilitate motion of the backrest 7 that can be actuated by a user providing a force to push against the backrest while seated in the seat 5 so that the backrest is tiltable to the reclined position and the seat 5 is moveable from its initial first position to a second position that corresponds with the backrest's reclined position. When the user removes the force (e.g. the user stops leaning back on the backrest while seated on the seat 5), the tilt mechanism 10 can effect movement of the backrest 7 from its reclined position to its upright position and also effect motion of the seat 5 from its second position to its first position.

The backrest 7 can include a backrest frame that is attached to or supports a back skin that a user may lean his or her back against when seated in the seat 5. The back skin can be a polymeric skin, a mesh skin, or a leather or fabric covering that covers a cushion supported by the backrest frame. The backrest 7 can include an upper portion 7*c*, a bottom portion 7*b* and an intermediate portion 7*d* between the upper portion 7*c* and lower portion 7*b*. The lower portion 7*b* can include a plurality of legs 7*a* that extend from the lower portion 7*b* of the backrest frame to the tilt mechanism 10. Each leg 7*a* can have a distal end 8 positioned in the housing 10*a* of the tilt mechanism 10 that is pivotally coupled to one or more structures of the tilt mechanism 10. At least a portion of each leg 7*a* can be enclosed within a side gaiter 3*e* that is connected to the housing 10*a*. In some embodiments, a first side gaiter that encloses at least a portion of a first leg 7*a* can be on a left side of the housing 10*a* between the front and back of the seat 5 and a second side gaiter can enclose at least a portion of a second leg 7*a* on a right side of the housing 10*a* between the front and back of the seat 5. The side gaiters 3*e* can each be positioned below the seat skin of the seat on which a user can sit. The side gaiters 3*e* can be attached to the base 3, the tilt mechanism housing 10*a* and/or the legs 7*a*. The side gaiters 3*e* can be positioned and configured to provide an enclosure structure to prevent exposed pinch points from the pivotal couplings of the legs 7*a* to other structure of the tilt mechanism 10. The side gaiters 3*e* can at least partially define a channel or passageway in which a respective leg is positioned and can also be composed of a resilient material or elastomeric material so that the gaiters 3*e* can bend or flex in response to contact with the legs 7*a* that may occur when the legs 7*a* tilt or otherwise move as the backrest 7 moves between the upright and reclined positions.

The tilt mechanism 10 can include a plurality of interconnected structures. These structures can include a vertically extending spring connecting member 11 that connects the coil spring 12 to the tilt mechanism 10 so that the coil spring 12 is able to provide a biasing force that is exertable on the seat 5 and backrest 7 to bias the backrest to its upright position and the seat 5 to its first position. It should be appreciated that there can be multiple spring connecting members 11 (e.g. a first spring connecting member 11 adjacent a left side of the coil spring and a second spring connecting member 11 adjacent a right side of the coil spring opposite the first spring connecting member 11). Each spring connecting mechanism can be positioned for operative connection to a respective leg 7*a* extending from the lower portion 7*b* of the backrest 7.

For each spring connecting member 11, a lower end 11*a* of the spring connecting member 11 can be connected to the coil spring 12 via a spring connection mechanism and the upper end 11*b* of the spring connecting member 11 can be pivotally connected to a respective first tilt member 21. The spring connection mechanism can be a spring plunger element that is configured so that a force is translatable from the spring connecting member to the spring 12 for pushing the spring 12 into a retracted position (or a compressed position) and to translate a force exerted by the spring 12 when the spring 12 extends from a retracted position, or compressed position. Each first tilt member 21 can extend from a first end 21*a* that is pivotally connected to the upper end 11*b* to which it is connected to a second end 21*b* that is pivotally connected to a second tilt member 23. The second tilt member 23 can extend from its second end 23*b* that is coupled to the second end 21*b* of the first tilt member 21 to its first end 23*a* that is pivotally coupled to the front distal end of the leg 7*a* via a pivotal connection mechanism 25.

The first tilt member 21 can have a plate 15 that extends therefrom. A moveable node 10*b* can be positioned on the plate 15 that is moveable along the upper surface of the plate 15 between a rear end 16 and a front end 18. The moveable node 10*b* can be horizontally moveable along an intermediate portion 17 between the front and rear ends 18 and 16 of the plate 15 coupled to the first tilt member 21 or that extends from the first tilt member 21. The movement of the moveable node 10*b* adjusts the leverage of the biasing force exerted by the coil spring 12 via the spring connecting member 11 and its pivotal connection to the first tilt member 21 as the first member pivots about the pivotal connection at the upper end 11*b* of the spring connecting member in addition to the moveable node 10*b*. The adjustment in leverage adjusts how much force is required from a user to compress the coil spring 12 to effect a recline of the backrest 7. For instance, in a "low tension" adjustable position, the spring is compressed a first distance Y1 shown in FIG. 17 and the spring 12 is compressed a second distance Y2 that is greater than the first distance Y1. This compressional distance change causes the spring connecting member 11 to drop further in height when the tilt mechanism 10 is in its high tension position (e.g. a position requiring more compression of a spring to get the backrest to recline to a position as compared to the lower tension position). While the moveable node 10*b* can permit the amount of force required for reclining of the backrest to be adjustable, it also can avoid any type of pre-tensioning on the coil spring 12 prior to any reclining motion so that there is no change in the coil spring position or configuration that occurs when the node 10*b* is moved. Motion of the node 10*b* results in changing the amount to which the coil spring is compressed due to the change of mechanical leverage that is applied during backrest tilting due to movement of the node 10*b*.

Movement of the node 10*b* can be effected by an actuator that is connected to a leverage adjustment mechanism. The actuator 6 can be a first actuator 6*a* that is coupled to an elongated rotatable member 10*c* that can be operatively connected to the node 10*b* to drive motion of the node 10*b*. Alternatively, the actuator 6 can be a second actuator 6*b* that can be operatively connected to a member so that movement of the actuator can drive motion of the node 10*b* between low and high tension positions that correspond to being closer or farther from the front side or rear side of plate 15.

In some embodiments, the motion of the node 10*b* can be effected by a node moving mechanism that is coupled to an adjustment actuator 6 for tension adjustment of the tilt mechanism 10 that can occur via mechanical leverage adjustment that is providable by movement of the node 10*b*. The node motion mechanism for leverage adjustment of the tilt mechanism can include the rotatable member 10*c* being coupled to an actuator 6 so that rotation of the actuator in a first rotational direction drives rotation of the rotatable member 10*c* in that first rotational direction and rotation of the actuator in a second rotational direction drives rotation of the rotatable member 10*c* in the second rotational direction (e.g. counterclockwise when the first rotational direction is clockwise or clockwise when the first rotational direction is counterclockwise). Rotation of the rotatable member 10*c* can result in the rotational motion of the rotatable member 10*c* being translated to forward or rearward movement of a node positioning member 10*e* that is connected to the rotatable member 10*c* so that rotation of the rotatable member in a first direction drives linear forward motion of the node positioning member 10*e* and rotation of the rotatable member 10*c* in the second rotational direction drives rearward motion of the node positioning member 10*e*. Examples of such connections between the rotatable member 10*c* and the node positioning member 10*e* can be a worm gear interconnection, other type of gear connection, or a cam system such as a helix cam system having notches or flats.

The interconnection between the rotatable member 10*c* and the node positioning member 10*e* can be configured to induce sufficient friction into the tilt mechanism system so that the axis about which the second end 21*b* of the first tilt member 21 may rotate does not move when the backrest is in a reclined position and/or is tilted away from the upright position towards the reclined position.

The node positioning member 10*e* can be connected to the node 10*b* so that the forward motion of the node positioning member 10*e* causes the node 10*b* to move forwardly along the plate 15 and the rearward motion of the node positioning member 10*e* causes the node to move rearwardly along the plate 15. In some embodiments, the rotatable member 10*c* can be connected to the node positioning member 10*e* via a gear connection mechanism 10*d* (e.g. a worm gear connection mechanism, etc.) such that rotation of the rotatable member 10*c* in a first rotational direction drives linear forward motion or rearward motion of the node positioning member 10*e* and node 10*b* and rotation of the rotatable member 10*c* in the opposite second rotational direction causes the node positioning member 10*e* and node 10*b* to move linearly in a linear direction opposite to the direction at which these structures move when the rotatable member 10*c* is rotated in the first rotational direction (e.g. backwardly if the linear motion is forwardly when the rotatable member is rotated in the first rotational direction and forwardly if the linear motion is backwardly when the rotatable member is rotated in the first rotational direction).

For instance, the rotatable member 10*c* can have teeth that mate with a worm gear or worm gear teeth of the node positioning member 10*e* or a gear connection mechanism 10*d* for providing a connection between the node positioning member 10*e* and the rotatable member 10*c* so that rotation of the rotatable member 10*c* about a horizontal axis that extends from the left side of the chair 1 to a right side of the chair 1 results in the worm gear teeth being contacted by the rotatable member teeth to drive the linear motion of the node positioning member 10*e* and node 10*b* forwardly and rearwardly (e.g. a direction that is perpendicular to the rotational axis of the rotatable member). As another example of a connection between the rotatable member 10*c* and the node positioning member 10*e* that can be provided so that rotation of the rotatable member 10*c* is translated into linear motion (e.g. forward or rearward motion) of the node positioning member 10*e*, the rotatable member 10*c* can have teeth that project outwardly and engaged in teeth of the gear connection mechanism 10*d* that engages to a bottom side or other side of the node positioning member 10*e* so that rotation of the rotatable member 10*c* drives linear motion of the node positioning member 10*e* that is perpendicular to the axis about which the rotatable member 10*c* rotates (e.g. forward and rearward motion when the axis of rotation of the rotatable member extends horizontally from a left side of the chair to a right side of the chair, etc.) via the intermeshing of the teeth of the rotatable member 10*c* and the teeth of the gear connection mechanism 10*d* operatively connected to the node positioning member 10*e*. In some embodiments, a driving wedge can be positioned between the gear connection mechanism 10*d* and the node positioning member 10*e* to push or pull the node positioning member 10*e* in response to rotation of the rotatable member 10*c* that is translated to the driving wedge via the gear connection mechanism 10*d*.

In yet other embodiments, the gear connection mechanism 10*d* can be integrated into the node positioning member 10*e* such that the node positioning member 10*e* has threads that mate with threads 10*t* of the rotatable member 10*c* to drive the linear motion of the node positioning member 10*e*. In some embodiments of such a connection, the rotational axis could be defined so that the linear motion of the node positioning member 10*e* traveled along the rotational axis about which the rotatable member rotates as it moves forwardly or rearwardly instead of a direction that is perpendicular to the rotational axis.

For some embodiments, the pitch of the thread 10*t* and the angle of the driving wedge can be pre-selected to define a number of turns an actuator coupled to the rotatable member 10*c* needs to be rotated to adjust the position of the node to adjust the recline force a user must exert to recline the backrest. But, if the pitch of the thread is selected solely to reduce the number of turns of an actuator 6 needed for quickly adjusting the tilt mechanism's ability to translate forces to the and from the spring 12, the friction induced could be too low and could result in movement of components of the tilt mechanism out of their selected position during recline, which would dynamically alter the force a user would need to exert to recline the backrest and provide an uncomfortable ride for the user experiencing such a recline motion.

For some embodiments, there may be node positioning members on opposite sides of a coil spring 12 (e.g. left and right sides above the coil spring 12 in the housing 10*a* of the tilt mechanism). For such embodiments, the first and second node positioning members 10*e* can each be connected to a respective node 10*b* (e.g. a first node 10*b* connected to a first node positioning member 10*e* and a second node 10*b* connected to a second node positioning member 10*e*). Each node can be moveable along a plate 15 extending from a first tilt member 21 to be moveable forwardly and rearwardly along that plate for adjusting mechanical leverage applied to the coil spring via recline of the backrest 7. Each node 10*b* can engage a respective first tilt member 21 (for such embodiments, the second set of first and second tilt members 21 and 23 and spring connecting member 11 can be considered third and fourth tilt members connected between a second leg 7*a* and a second spring connecting member 11).

It should be appreciated that the node 10*b* is configured so that its position is not adjusted during tilting of a backrest or seat 5. The forward or rearward positional adjustment of the node 10*b* can be effected by the rotation of rotatable member 10*c* as discussed herein. During tilting, the node 10*b* will not move. Friction provided via the connection between the rotatable member 10*c* and the node positioning member 10*e* can help ensure that the node 10*b* stays in its selected position so that the desired portion of leverage is applied for the translation of force to and from the spring 12.

In some embodiments, there may be a recline limiter mechanism 30 that is configured to set a maximum amount of recline tilting that the tilt mechanism 10 will permit (e.g. the reclined position can be limited so that the reclined position is at different fully reclined positions from a more reclined position to a less reclined position). The recline limiter mechanism can be considered a tilt limiter mechanism by being configured to be adjusted to different positions to adjust an extent to which a backrest is tiltable, or reclineable. In some embodiments, the recline limiter mechanism can be configured to prevent the backrest 7 from being reclined so that it always stays in the upright position when the recline limiter mechanism is adjusted to a non-tilting position. Such a recline limiter (or tilt limiter) can be connected to an actuator 6 such as the second actuator 6*b* or a third actuator 6*c* that may be moveable to adjust a position of stepped recline limiting members 31*s* that each engage a respective first tilt member 21 at its second end 21*b* to limit the extent to which that first tilt member 21 is movable for limiting the path of recline for the backrest 7. Each recline limiting member 31*s* can be considered a tilt limiting member in some embodiments. A position of the recline limiting member 31*s* can be adjusted via manipulation of an actuator to adjust the position of the recline limiting member.

Figure 24:
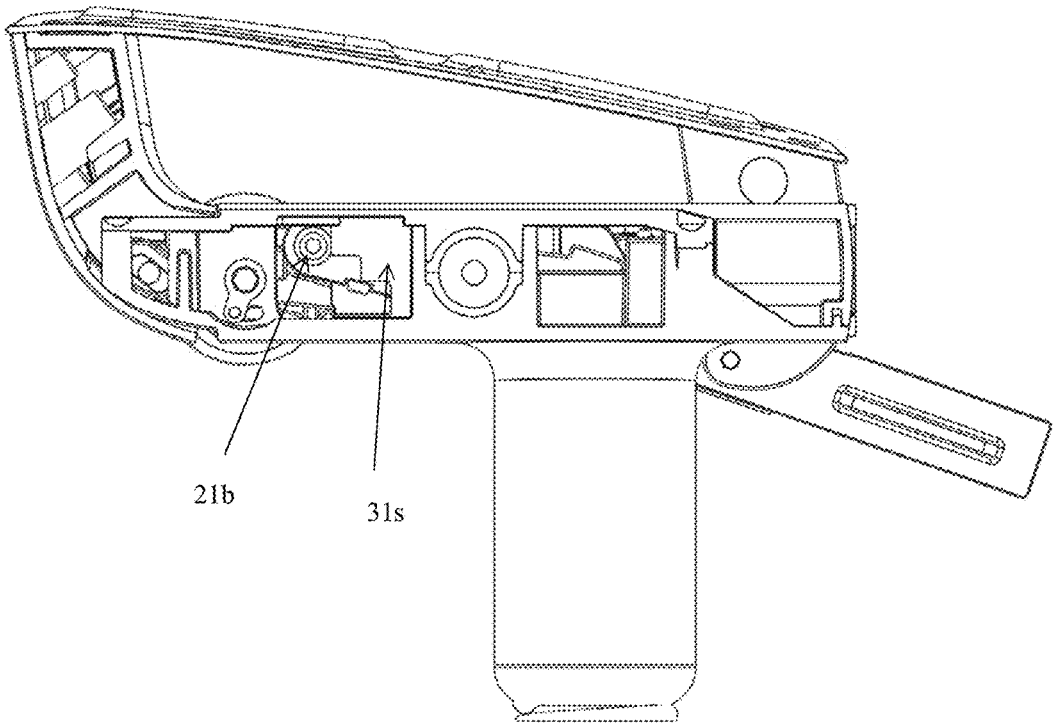
FIG. 24 is a is a fragmentary side view of the first exemplary embodiment of the chair with portions of the chair cut away to illustrate components of the tilt limiting mechanism in a full travel position.
Figure 25:
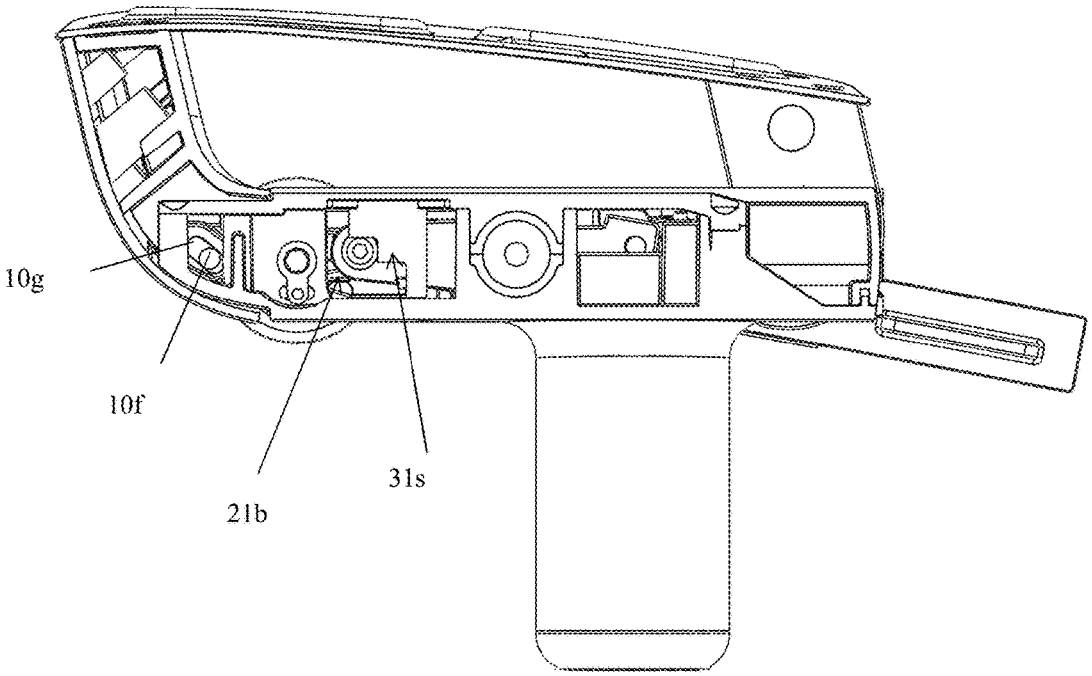
FIG. 25 is a is a fragmentary side view of the first exemplary embodiment of the chair with portions of the chair cut away to illustrate components of the tilt limiting mechanism in a mid travel position
Figure 26:
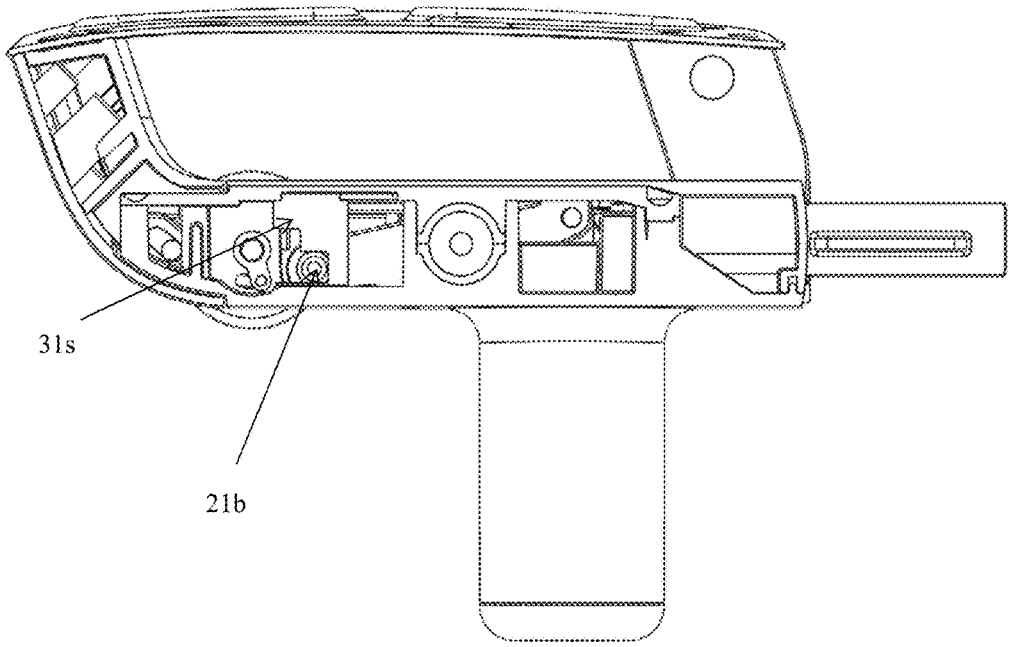
FIG. 26 is a is a fragmentary side view of the first exemplary embodiment of the chair with portions of the chair cut away to illustrate components of the tilt limiting mechanism in a non-tilting, or non-travel position

Each stepped recline limiting member 31*s* can be coupled to a moveable actuator such as a third actuator 6*c* that is connected to a detent mechanism connecting the third actuator 6*c* to the stepped recline limiting member 31*s* so that a motion of the third actuator can move the stepped recline limiting member between multiple different positions. Those positions can include a position corresponding to a non-travel position that prevents the backrest from moving as shown in FIG. 26, a mid travel position that permits the backrest to travel from an upright position to a mid-reclined position as shown in FIG. 25, and a full recline position that permits the backrest 7 to move between its upright position and its fully reclined position as shown in FIG. 24. The detent mechanism 41 can be configured to define these multiple positions and be configured to move between these positions via a connection to the third actuator 6*c*. The detent mechanism can include a first spring 42 to help facilitate movement of third actuator 6*c* to provide a desired feel for user motion of the actuator and to hold the actuator in different user selected positions. The detent mechanism can also include a second spring 45 that is moveable to facilitate adjustment of the recline limiter mechanism 30 between multiple different positional settings defined by apertures in which the detent is positionable as a result of motion of the actuator. The second spring 45 can be structured as a leaf spring or other type of spring member that configured to help prevent motion of the detent when the tilt mechanism 10 is in use via recline of the backrest so that the user is unable to exert a force on the tilt mechanism to try and prevent recline of the backrest when the backrest is already reclined. For instance, the spring member of the second spring 45 can be positioned to bend or otherwise resiliently move (e.g. extend or flex) in response to motion of the third actuator 6*c* when the backrest is reclined and the user's force has exerted a load on the tilt mechanism for recline of the backrest. The biasing force of the second spring 45 can be pre-selected so that this biasing force is unable to force the detent out of its position when the user's recline force acts on the tilt mechanism to recline the backrest so that the detent does not move with the second spring 45, but instead stays in its position, which forces the spring to bend or otherwise extend in response to the motion of the actuator without moving the detent. When the user removes the exerted recline force so that the backrest is returned to its upright position via the spring 12, the second spring 45 of the detent mechanism 41 can be configured to retract back to its biased, unextended position as the biasing force provided by the second spring 45 can now overcome the force acting on the detent mechanism that previously prevented the detent from being moved out of its position. The second spring 45 can be connected to the detent so that this retraction of the second spring 45 results in the detent moving from its initial position to the new position that the user set via motion of the actuator only when the backrest is in the upright position. Providing this type of a delay in adjustment of the detent's position via the second spring 45 can help prevent the user from breaking components of the tilt mechanism 10 by overloading the components when they are in use via the delayed effectuation of the adjustment initiated by the movement of the actuator that can occur when the backrest is already reclined.

The recline travel of the backrest can be configured to also synchronously move the seat 5 via the tilt mechanism. For instance, the tilt mechanism 10 can include at least one shaft 10*f* that extends through one or more slots 10*g*. The shaft 10*f* can be connected to the tilt mechanism 10 so that motion of the backrest between the upright and reclined positions causes the shaft 10*f* to move between front and rear ends of the slot(s) 10*g*. The seat 5 can be connected to this shaft 10*f* so that the motion of the shaft within the slot(s) 10*g* drives motion of the seat (e.g. tilting motion, forward or rearward motion, both tilting and rearward/forward motion, etc.). Each of the slots 10*g* can have an arcuate shape or other shape to help define the path of travel of the seat to be permitted via tilting of the backrest to help guide the motion of the seat 5 and to help provide friction to the backrest tilting motion to help provide a desired ride, or feel, to the synchronous motion of the seat and backrest that can occur via tilting of the backrest.

Legs 7*a* of the backrest that can extend from a lower portion of the frame of the backrest can be pivotally connected to vertical arms 3*i* of the tilt mechanism 10 at pivotal connections 3*h* so that tilting motion of the backrest can also result in a tilting motion of the arms 3*i*. The arms 3*i* can extend to the seat or the seat frame of the seat for supporting the seat and to help drive tilting of the seat in response to tilting of the legs 7*a* via the pivotal connections 3*h*.

For embodiments of the chair that include a backrest 7 having two legs 7*a*, the tilt mechanism 10 can include two sets of interconnecting structures for operatively connecting the coil spring 12 to each leg 7*a* of the backrest via a respective set of interconnecting structures. Each leg 7*a* can be connected to the tilt mechanism 10 via a corresponding set of structures as discussed herein (e.g. each leg 7*a* can be connected to a respective set of spring connecting member 11, and first and second tilt connecting members 21 and 23 etc.). In other embodiments, it is contemplated that only one leg 7*a* may be connected to the coil spring 12 via the tilt mechanism 10 and any other legs may only be pivotally connected to other structure to facilitate level, balanced rotation relative to the base that is driven by the coil spring 12 connection to only one of the legs 7*a*.

It should be appreciated that embodiments of the chair may utilize many different feature arrangements to meet different sets of design criteria. For instance, it should be appreciated that some components, features, and/or configurations may be described in connection with only one particular embodiment, but these same components, features, and/or configurations can be applied or used with many other embodiments and should be considered applicable to the other embodiments, unless stated otherwise or unless such a component, feature, and/or configuration is technically impossible to use with the other embodiment. Thus, the components, features, and/or configurations of the various embodiments that can be appreciated from the disclosure provided herein can be combined together in any manner and such combinations are expressly contemplated and disclosed by this statement.

For example, the seat 5 may be a unitary structure composed of polymeric material or may be a structure that has many interconnected components, such as a foam member that is positioned between a fabric or leather covering and a rigid plate component or other intermediate structural component positioned above the feet or castors of the chair and below the seat 5 of the chair. For instance, the seat may include a covering that may be a fabric or mesh material that is sewn, adhered or otherwise attached to a relatively rigid polymeric plate or metal plate to enclose a foam member, such as a foam cushion. As yet another example, it should be appreciated that the shape and configuration of the base of the chair may be any of a number of different configurations needed to meet a particular design objective that permit the base to support the seat, chair back, and a user sitting on the seat and leaning on the chair back. As yet another example, the height adjustment mechanism used to actuate seat height adjustment may include only one gas spring or may include another type of lifting mechanism coupled to an actuator that is manipulatable to actuate height adjustment (e.g. a button, lever, or other actuator that is coupled to a component of the height adjustment mechanism via a connector such as a wire or cable or lever such that manipulation of the actuator causes the height adjustment mechanism to move to permit adjustment of the height of the seat). As yet another example, embodiments of the tilt mechanism can be configured to only effect tilting of the backrest such that the seat is independently moveable relative to the backrest and does not tilt or otherwise move synchronously with backrest tilting.

As yet another example, each of the armrests 9 can be configured to be affixed in a stationary manner or may be configured to be moveably attached to permit rotational and/or height adjustment of the position of the armrest. The armrests can be attached to the backrest frame, the backrest, the seat frame of the seat, the seat, or the base, and/or a housing or other element positioned under the seat frame 5 that is supported by legs or a pedestal base. As yet another example, the spring 12 can be a metal coil spring 12, an elastomeric spring member, an annular structured elastomeric member, a polymeric member that is resilient and annular in shape (e.g. tubular in shape, a polygonal shaped tube having an inner central channel defined therein, etc.) to function as a spring and move between retracted and extended positions within a channel of a column, or other type of spring member. As yet another example, the composition of the structures of the housing, backrest, armrest, and seat frame can be any of a number of different suitable materials. For example, all of these components may be composed of a polymeric material, or some may be composed of a polymeric material while others are composed of metal or other type of material. Therefore it should be understood that while certain exemplary embodiments of a chair and methods of making and using a chair have been discussed and illustrated herein, it is to be distinctly understood that the invention is not limited thereto but may be otherwise variously embodied and practiced within the scope of the following claims.

What is claimed is:

1. A chair comprising:

a seat;

a backrest, the backrest comprising a frame having a lower portion and a first leg that extends forwardly from the lower portion to a position below the seat and within a housing of a tilt mechanism;

a base, the seat supported by the base, the tilt mechanism attached to the base, the tilt mechanism comprising:

a spring that is positioned to extend vertically within a column, the spring being compressible and extendable;

a first spring connecting member that has a lower end connected to the spring and an upper end pivotally connected to a first end of a first tilt member;

a second end of the first tilt member pivotally connected to a second end of a second tilt member;

a first end of the second tilt member pivotally connected to a portion of a forward distal end of the first leg extending from the lower portion of the frame of the backrest.

2. The chair of claim 1, wherein the spring is a coil spring and the coil spring is positioned around a gas spring within the column that is actuatable for height adjustment of the seat.

3. The chair of claim 1, wherein the frame of the backrest has a second leg that extends forwardly form the lower portion to a position below the seat that is within a housing of a tilt mechanism and the tilt mechanism also comprises:

a second spring connecting member that has a lower end connected to the spring and an upper end pivotally connected to a first end of a third tilt member;

a second end of the third tilt member pivotally connected to a second end of a fourth tilt member;

a first end of the fourth tilt member pivotally connected to a portion of a forward distal end of the second leg extending from the lower portion of the frame of the backrest.

4. The chair of claim 3, wherein the spring is a coil spring and the coil spring is positioned around a gas spring within the column that is actuatable for height adjustment of the seat such that the gas spring is positioned within an inner conduit of the coil spring.

5. The chair of claim 3, wherein the tilt mechanism has a leverage adjustment mechanism, the leverage adjustment mechanism comprising:

an actuator connected to a rotatable member for leverage adjustment;

the rotatable member connected to a first node positioning member so that rotation of the rotatable member in a first rotational direction drives linear motion of the first node positioning member in a forward direction and rotation of the rotatable member in a second rotational direction that is opposite the first rotational direction drives motion of the first node positioning member in a rearward direction;

the rotatable member also connected to a second node positioning member so that rotation of the rotatable member in the first rotational direction drives linear motion of the second node positioning member in a forward direction and rotation of the rotatable member in the second rotational direction drives motion of the second node positioning member in a rearward direction;

a first node that engages the first tilt member, the first node attached to the first node positioning member such that the first node moves forwardly when the first node positioning member is moved forwardly via rotation of the rotatable member in the first rotational direction and the first node moves rearwardly when the first node positioning member is moved rearwardly via rotation of the rotatable member in the second rotational direction; and a second node that engages the third tilt member, the second node attached to the second node positioning member such that the second node moves forwardly when the second node positioning member is moved forwardly via rotation of the rotatable member in the first rotational direction and the second node moves rearwardly when the second node positioning member is moved rearwardly via rotation of the rotatable member in the second rotational direction.

6. The chair of claim 5, wherein motion of the first node and second node adjusts a mechanical leverage applicable to the spring to adjust an amount of force needed to be exerted on the backrest to compress the spring.

7. The chair of claim 6, wherein the spring is a coil spring and the coil spring is positioned around a gas spring within the column that is actuatable for height adjustment of the seat.

8. The chair of claim 7, comprising:

a tilt limiter mechanism, the tilt limiter mechanism comprising:

a moveable actuator connected to a tilt limiter member within the housing of the tilt mechanism, the tilt limiter member positioned within a slot defined by structure within the housing of the tilt mechanism such that movement of the moveable actuator connected to the tilt limiter member adjusts a position of the tilt limiter member within the slot.

9. The chair of claim 1, comprising:

a tilt limiter mechanism, the tilt limiter mechanism comprising:

a moveable actuator connected to a tilt limiter member within the housing of the tilt mechanism, the tilt limiter member positioned within a slot defined by structure within the housing of the tilt mechanism such that movement of the moveable actuator adjusts a position of the tilt limiter member within the slot.

10. The chair of claim 1, wherein the tilt mechanism has a leverage adjustment mechanism, the leverage adjustment mechanism comprising:

an actuator connected to a rotatable member;

the rotatable member connected to a node positioning member so that rotation of the rotatable member in a first rotational direction drives linear motion of the node positioning member in a forward direction and rotation of the rotatable member in a second rotational direction that is opposite the first rotational direction drives motion of the node positioning member in a rearward direction;

a node that engages the first tilt member, the node attached to the node positioning member such that the node moves forwardly when the node positioning member is moved forwardly via rotation of the rotatable member in the first rotational direction and the node moves rearwardly when the node positioning member is moved rearwardly via rotation of the rotatable member in the second rotational direction.

11. The chair of claim 10, wherein the node is positioned so that motion of the node to adjust a position of the node adjusts a mechanical leverage applicable to the spring to adjust an amount of force needed to be exerted on the backrest to compress the spring; and the chair also comprising:

a tilt limiter mechanism, the tilt limiter mechanism comprising:

a moveable actuator connected to a tilt limiter member within the housing of the tilt mechanism, the tilt limiter member moveably positioned to engage the first tilt member, the tilt limiter member being stepped so that a first position of the tilt limiter member prevents recline of the backrest, a second position of the tilt limiter permits the first tilt member to move so that the backrest is adjustable from the upright position toward the reclined position, and a third position of the tilt limiter permits the first tilt member to move so that the backrest is moveable to a position that is between the upright position and the reclined position.

12. The chair of claim 11, wherein the tilt limiter mechanism also comprises a shaft positioned within a slot, the shaft connected to the tilt limiter member such that the shaft is moveable within the slot when a position of the tilt limiter member is adjusted.

13. The chair of claim 12, wherein the tilt limiter mechanism also comprises a first spring that is configured to facilitate movement of the actuator of the tilt limiter mechanism and a second spring that is configured to provide a pre-selected biasing force to prevent adjustment of the tilt limiter member when the backrest is in the reclined position.

14. The chair of claim 13, wherein the second spring is positioned so that the second spring is connected to the tilt limiter member so that the second spring moves in response to the actuator of the tilt limiter mechanism being adjusted only when the backrest is in the upright position to effect motion of the tilt limiter member in response to movement of the actuator.

15. A method of using a chair comprising:

providing the chair of claim 1;

adjusting a position of a node that engages the first tilt member such that the node moves forwardly or rearwardly to adjust a mechanical leverage applicable to the spring to adjust an amount of force needed to be exerted on the backrest to compress the spring and recline the backrest; and manipulating an actuator of a tilt limiter mechanism of the chair to adjust an extent to which the backrest is reclineable while the backrest is reclined.

16. The method of claim 15, wherein the adjusting of the position of the node occurs via the node moving forwardly or rearwardly along a plate of the first tilt member.

17. The method of claim 16, comprising:

delaying adjustment of the tilt limiter mechanism to occur via the manipulating of the actuator of the tilt limiter mechanism so that adjustment of the tilt limiter mechanism is only effected after the backrest is moved to the upright position and is no longer reclined.

18. The method of claim 17, wherein delaying adjustment of the tilt limiter mechanism comprises:

a spring of the tilt limiter mechanism having a pre-selected biasing force resiliently moving in response to motion of the actuator of the tilt limiter mechanism while the backrest is reclined to prevent adjustment of a detent mechanism for adjusting a position of a tilt limiter member when the backrest is reclined, the pre-selected biasing force being a force that is less than a force needed to overcome force acting on the tilt limiter mechanism when the backrest is reclined to prevent overloading of components of the chair.

19. The method of claim 15, comprising:

delaying adjustment of the tilt limiter mechanism to occur via the manipulating of the actuator of the tilt limiter mechanism so that adjustment of the tilt limiter mechanism is only effected after the backrest is moved to the upright position and is no longer reclined.

20. The method of claim 19, wherein the delaying of the adjustment of the tilt limiter mechanism comprises:

a spring of the tilt limiter mechanism having a pre-selected biasing force resiliently moving in response to motion of the actuator of the tilt limiter mechanism while the backrest is reclined to prevent adjustment of a detent mechanism for adjusting a position of a tilt limiter member when the backrest is reclined, the pre-selected biasing force being a force that is less than a force needed to overcome force acting on the tilt limiter mechanism when the backrest is reclined to prevent overloading of components of the chair.

* * * * *